US008633957B2

(12) United States Patent
Sugiyama

(10) Patent No.: US 8,633,957 B2
(45) Date of Patent: Jan. 21, 2014

(54) IMAGE FORMING APPARATUS WITH DIFFERENT CLOCK OUTPUTS FOR TONER AND NON-TONER FORMING REGIONS

(75) Inventor: Norikazu Sugiyama, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/196,264

(22) Filed: Aug. 2, 2011

(65) Prior Publication Data

US 2012/0230713 A1 Sep. 13, 2012

(30) Foreign Application Priority Data

Aug. 10, 2010 (JP) ..... 2010-179505
May 19, 2011 (JP) ..... 2011-112636

(51) Int. Cl.
*B41J 2/435* (2006.01)
*B41J 2/47* (2006.01)

(52) U.S. Cl.
USPC ..... 347/237; 347/247

(58) Field of Classification Search
USPC ..... 347/237–240, 247, 251–255
See application file for complete search history.

(56) References Cited

U.S. PATENT DOCUMENTS 5,260,799 A * 11/1993 Loce et al. ..... 358/300
6,144,817 A 11/2000 Takeuchi et al.
2007/0115339 A1* 5/2007 Matsuzaki et al. ..... 347/118

FOREIGN PATENT DOCUMENTS

JP 2000-131899 A 5/2000
JP 2003-312050 A 11/2003
JP 2003-323012 A 11/2003

* cited by examiner

*Primary Examiner* — Hai C Pham
(74) *Attorney, Agent, or Firm* — Fitzpatrick, Cella, Harper & Scinto

(57) ABSTRACT

The image forming apparatus includes a BG exposure clock output section 305 which outputs a BG exposure clock f1 that slightly emits light from a laser for BG exposure toward a non-toner image forming region on a photosensitive drum 222 and a laser control section 308 which controls the laser so as to slightly emit light for BG exposure based on the BG exposure clock f1 output from the BG exposure clock output section 305. The BG exposure clock output section 305 outputs a clock for BG exposure with a frequency diffused in the range from f1min to f1max.

21 Claims, 15 Drawing Sheets

T0: MINIMUM ENSURED TIME FOR TURNING-ON OF LASER

Pd: MAXIMUM RATED VALUE OF LASER CURRENT

T0: MINIMUM ENSURED TIME OF TURNING-OFF OF LASER

T0: MINIMUM ENSURED TIME OF TURNING-OFF OF LASER

IMAGE FORMING APPARATUS WITH DIFFERENT CLOCK OUTPUTS FOR TONER AND NON-TONER FORMING REGIONS

BACKGROUND OF THE INVENTION

1. Field of the Invention

The present invention relates to an image forming apparatus such as a printer and a copy machine, and more particularly to an electrophotographic image forming apparatus.

2. Description of the Related Art

Such an electrophotographic image forming apparatus obtains a color image by a method in which a recording image (toner image) formed on a photosensitive drum as an image bearing member by charging, exposing and developing is transferred to a recording material repeatedly in plural processes to form a multi-color superposed image on the recording material. However, in the color image forming apparatus, a phenomenon in which an unwanted white gap appears between adjacent images of different colors may occur. The reason for this is as follows. In an electrostatic latent image that is formed in a condition in which a drum surface potential sharply changes, for example, an image edge portion is formed on a photosensitive drum, in the case where this portion is developed by a development apparatus, a visible image may be formed thinner than the electrostatic latent image originally formed on the photosensitive drum. Hereinafter, this phenomenon is referred to as a "white gap". When a single color image is formed, any thinned image causes no problem because there is no adjacent color. However, when a color image is formed in a state in which for example, the image having a cyan color band is tried to be adjacent to a black color band, the cyan color band and the black color band in the image are respectively formed with thinner bands than those to be. Consequently, there is a problem to cause a gap between the cyan color and the black color in the final image formed on the recording material. FIG. 15A depicts the detail of the white gap according to a conventional technique and illustrates the electric field between a developing roller 226 and a photosensitive drum 222. In a portion of a visible image, the thinning of the visible image that causes a white gap occurs because the electric field is convoluted in an edge portion of an electrostatic latent image in an electrostatic portion formed on the photosensitive drum.

In order to solve this problem, there has been known a method of preventing image thinning by causing a light emitting element of a laser scanner to emit light slightly enough to prevent excessive toner adhesion in a non-print region (non-toner image forming region) (image background portion) in an entire printable region. Hereinafter, this method is referred to as background exposure. However, the purpose of the background exposure is not limited to preventing the white gap. For example, as disclosed in Japanese Patent Application Laid-Open No. 2003-323012, the background exposure is also performed as a reverse fog measure for a large potential difference (back contrast) between a developing bias potential and a primary charge bias. In addition, as disclosed in Japanese Patent Application Laid-Open No. 2000-131899, the background exposure is also performed as a measure for preventing air discharge (toner scattering) occurring in a transfer nip portion by reducing transfer potential contrast. In other words, the background exposure in the present description is not limited to the preventive measure for a specific purpose.

Here, examples of the preventive measure against the background exposure include a method of changing the duty ratio of a pulse wave, referred to as a PWM (Pulse Width Modulation). The method is to cause the light emitting element of the laser scanner to emit light with a pulse width corresponding to a slight light emission in a non-print region in synchronism with an image clock as a fixed frequency. Here, in the case where almost all print regions are white, the light emitting element slightly emits light over the entire print region so that fixed thin pulses occurs over the entire print region as a drive signal of the light emitting element of the laser scanner. As a result, there is a problem in that unnecessary radiation wave having a frequency corresponding to a pulse cycle of slight light emission greatly occurs. One solution of this problem is disclosed in Japanese Patent Application Laid-Open No. 2003-312050. According to Japanese Patent Application Laid-Open No. 2003-312050, the pulse width corresponding to a laser emission time period is randomly modulated and background exposure is performed based on the modulated pulse width to reduce unnecessary radiation wave.

Although the conventional technique as disclosed in Japanese Patent Application Laid-Open No. 2003-312050 can be expected to exert a protective effect against noise having a frequency higher than the image clock, it may not be sufficient for noise having a frequency band of the image clock. FIG. 15B describes the relation between an exposure pattern (emission pattern) and an electric field intensity distribution of unnecessary radiation noise. In FIG. 15B, the width A denotes a laser emission time period width (second) to drive the light emitting element of the laser scanner, and the width B denotes a total laser emission period (second) of the emission time period width and the non-emission time period width of the light emitting element of the laser scanner. Here, consideration is given to an electric field intensity distribution of unnecessary radiation when the light emitting element of the laser scanner is driven with the laser emission time period width A and the laser emission period B. Unnecessary radiation noise due to the laser emission time period width A occurs at a frequency of $(1/A)\times n$ [MHz] (n is a positive integer). Unnecessary radiation noise due to the laser emission period B occurs at a frequency of $(1/B)\times n$ [MHz] (n is a positive integer). Note that noise in a frequency band of the image clock refers to noise having a frequency illustrated by the width B in FIG. 15B. In light of this, unnecessary radiation measure members such as a shield, a filter and a core can be provided to reduce noise. However, an addition of an unnecessary radiation measure member may lead to an increase in cost, mounting area/volume, and weight. Thus, a simple measure is required to reduce noise in the frequency band of the image clock.

In view of this, it is an object of the present invention to solve at least one of the above and other problems. It is an object of the present invention to reduce an electric field intensity of an electromagnetic wave occurring as unnecessary radiation by means of a simple configuration.

SUMMARY OF THE INVENTION

The purpose of the present invention is to solve the aforementioned problems.

Another purpose of the invention is to provide an image forming apparatus that emits light from a light emitting element for a toner image forming region on a photosensitive member according to input image data and exposes the photosensitive member, the image forming apparatus including a first clock output unit that outputs a clock to slightly emit light from the light emitting element for non-toner image forming region on the photosensitive member and a control unit which based on the clock output from the first clock output unit, slightly emits light from the light emitting element to slightly exposure on the photosensitive member, wherein the first clock output unit outputs a clock for performing the slight exposure with a frequency diffused within a predetermined frequency range.

A further purpose of the invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Preferred embodiments of the present invention will now be exemplarily described in detail in accordance with the accompanying drawings. Note that the components described in the embodiments are just examples and the scope of the present invention should not be construed to limit to these.

First Embodiment

<Schematic Sectional View of Image Forming Apparatus>

Figure 1:
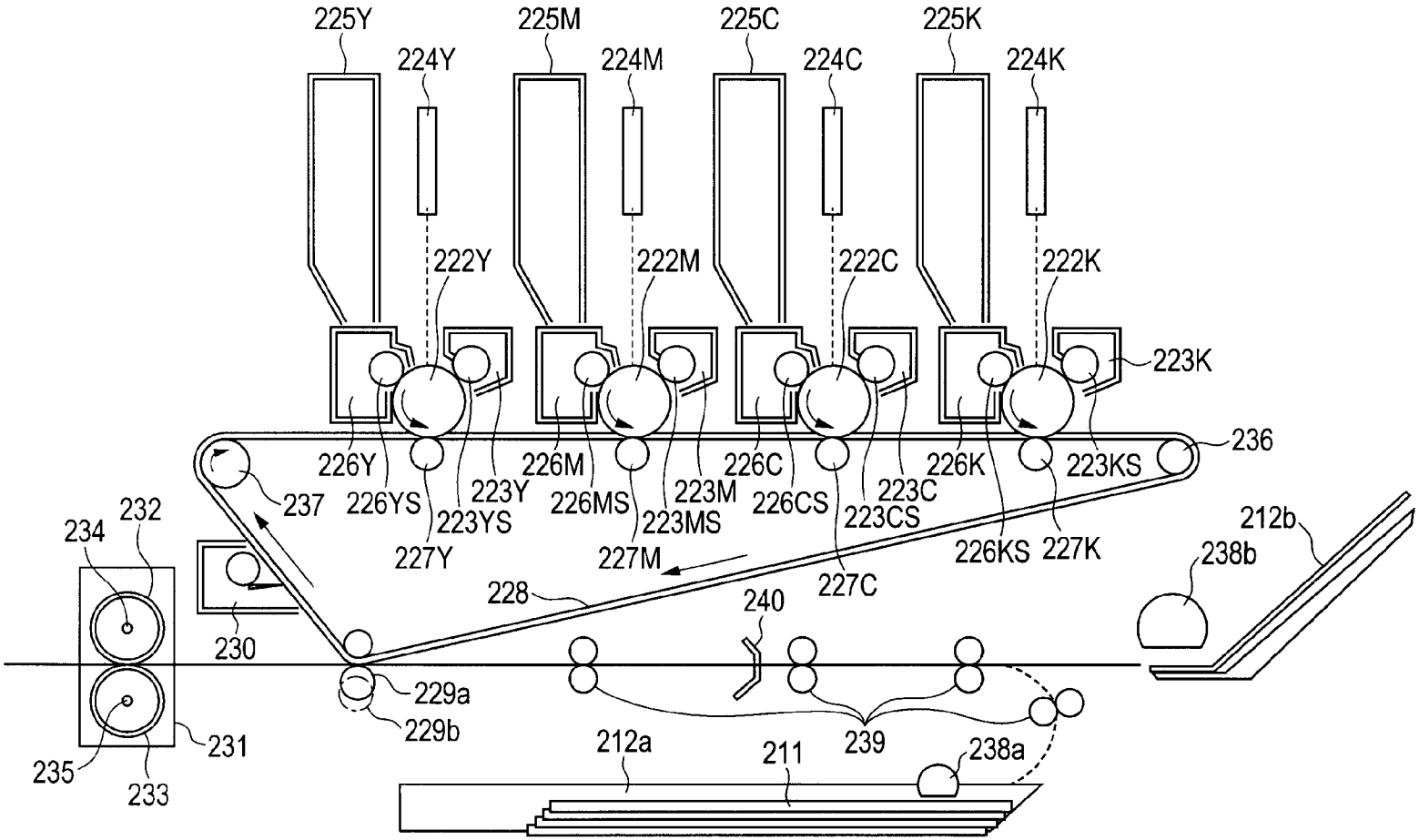
FIG. 1 is a sectional view depicting a tandem color image forming apparatus adopting an intermediate transfer belt of a first embodiment.

FIG. 1 is a sectional view illustrating a color image forming apparatus having an image forming section as an image forming unit of four colors (yellow Y, magenta M, cyan C, and black K) of a first embodiment. The color image forming apparatus illustrated in FIG. 1 is a tandem color image forming apparatus adopting an intermediate transfer belt as an example of an electrophotographic color image forming apparatus. A charging section as a charging unit has four injection chargers 223 for charging photosensitive drums 222Y, 222M, 222C, and 222K (hereinafter Y, M, C, and K may be omitted) for each station of yellow Y, magenta M, cyan C, and black K. Each injection charger 223 has respective charging rollers 223YS, 223MS, 223CS, and 223KS. Each photosensitive drum 222 is configured such that an organic photoconductive layer is applied on an outer periphery of an aluminum cylinder and is rotated by transmission of drive force of an unillustrated drive motor. The drive motor rotates each photosensitive drum 222 counterclockwise according to image forming operation. The laser scanner 224 in an exposure section as an exposure unit drives a light emitting element such as a laser diode to emit exposure light according to the exposure time processed by a data control section described later in FIG. 3. The laser scanner 224 causes a light emitting element to emit exposure light toward a toner image forming region on a photosensitive drum 222 (on an image bearing member), for example, according to image data input through a later described host I/F section 202 to form an electrostatic latent image. In other words, the laser scanner 224 irradiates the photosensitive drum 222 with exposure light and selectively exposes the surface of the photosensitive drum 222 to form an electrostatic latent image.

A developing section as a developing unit has four developers 226Y, 226M, 226C, and 226K developing yellow Y, magenta M, cyan C and black K for each station to visualize an electrostatic latent image. Each developer 226 develops and visualizes the electrostatic latent image to form a single color toner image. Each developer 226 has respective developing rollers 226YS, 226MS, 226CS, and 226KS. Each developer 226 is attachable and detachable. Each of the toner containers 225Y, 225M, 225C, and 225K supplies each color toner to respective developers 226Y, 226M, 226C, and 226K. A transfer section as a transfer unit applies an appropriate bias voltage to a primary transfer roller 227. The transfer section not only applies the bias voltage to the primary transfer roller 227 but also differentiates the rotational speed of the photosensitive drum 222 from the rotational speed of the intermediate transfer belt 228 and thereby efficiently transfers a single color toner image to the intermediate transfer belt 228. This transfer is referred to as a primary transfer. The drive roller 237 rotates clockwise by transmission of drive force of an unillustrated drive motor. The follower roller 236 follows the intermediate transfer belt 228. The primary transfer roller 227 superposes single color toner images on the photosensitive drums 222 onto the intermediate transfer belt 228 to form a multi-color toner image.

Further, the transfer section as the transfer unit superposes single color toner images on the intermediate transfer belt 228 for each station and transfers the superposed multi-color toner image to a secondary transfer roller 229*a* with rotation of the intermediate transfer belt 228. Meanwhile, a recording material 211 is fed from a paper feed cassette 212*a* holding the recording material 211 by a paper feed roller 238*a*. Then, the recording material 211 is conveyed through each pairs of conveying rollers 239 and conveyed to a secondary transfer roller 229*a*, where the multi-color toner image on the intermediate transfer belt 228 is transferred to the recording material 211. An appropriate bias voltage is applied to the secondary transfer roller 229*a* to electrostatically transfer the toner image. This transfer is referred to as a secondary transfer. While the multi-color toner image is being transferred on the recording material 211, the secondary transfer roller 229*a* is in contact with the recording material 211 at the position 229*a*, and after the print process completes, the secondary transfer roller 229*a* moves away from the recording material 211 to the position 229*b*. The recording material 211 may be disposed in a sheet supply tray 212*b*. In this case, the recording material 211 is fed from the sheet supply tray 212*b* by a paper feed roller 238*b*. Then, the recording material 211 is conveyed through pairs of conveying rollers 239 and conveyed to the secondary transfer roller 229*a*. A conveyance sensor 240 detects whether or not the recording material 211 is conveyed at a desired timing. When the recording material 211 is not conveyed, various kinds of jams (for example, a conveyance delay jam) are reported to an unillustrated video controller and the like.

A fixing section 231 as a fixing unit has a fixing roller 232 heating the recording material 211 and a pressure roller 233 press-contacting the recording material 211 to the fixing roller 232 to melt-fix the multi-color toner image transferred to the recording material 211 to the recording material 211. The fixing roller 232 and the pressure roller 233 are formed into a hollow shape, inside of which heaters 234 and 235 are housed respectively. The fixing section 231 conveys the recording material 211 holding the multi-color toner image by means of the fixing roller 232 and the pressure roller 233. Further, the fixing section 231 heats and pressurizes toner to be fixed to the recording material 211. After the toner is fixed, the recording material 211 is discharged to an unillustrated discharge tray by an unillustrated discharge roller to complete the image forming operation. A cleaning section 230 cleans toner remaining on the intermediate transfer belt 228. After the four-color toner image formed on the intermediate transfer belt 228 is transferred to the recording material 211, the remaining waste toner is accumulated in a cleaner container (not-shown).

<Functional Block Diagram of Image Forming Apparatus>

Figure 2:
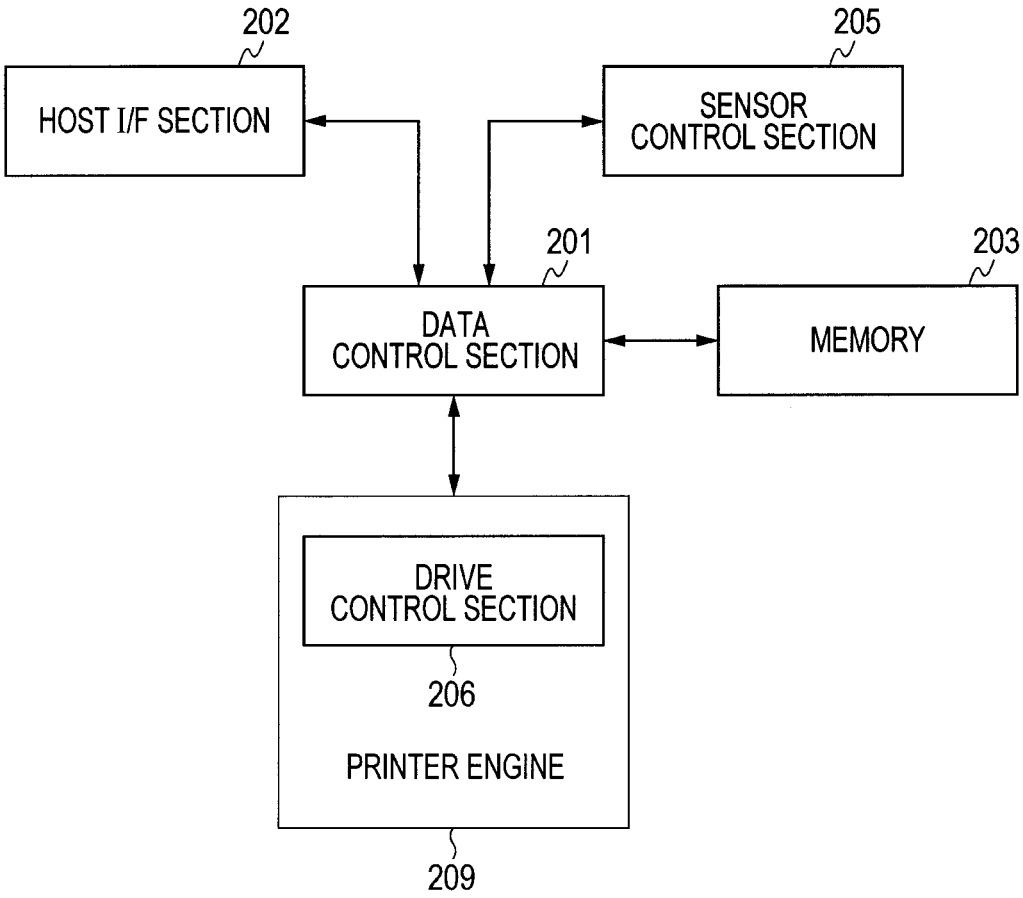
FIG. 2 depicts an entire control section of the first embodiment.

FIG. 2 describes an entire control section of the present embodiment. A data control section 201 is implemented by a single-chip microcomputer or the like, and controls and manages the entire apparatus. A host I/F section 202 communicates with a printer and an external device (for example, a personal computer (hereinafter simply referred to as a PC)). A memory 203 holds print data, various parameters, various types of information and the like. The memory 203 collectively includes a volatile memory and a non-volatile memory. A sensor control section 205 detects the state of each section of the printer such as a sheet detection sensor. A drive control section 206 drives and controls actuators, a laser, a high pressure power supply, and the like of the printer engine 209.

When print image data is output from the PC to the printer through the host I/F section 202, the data control section 201 converts the print data output from the PC to the printer to data suitable for the system of the printer engine 209. When the printer engine enters a printable state, the drive control section 206 starts to drive the photosensitive drum 222 and the intermediate transfer belt 228 connected to a drive unit including unillustrated motors and gears. Then, each color image signal is output to respective color laser scanners 224 to form an electrostatic latent image on the photosensitive drum 222. Then, the toner is developed by the developer 226. Subsequently, the primary transfer and the secondary transfer are performed in series as described in FIG. 1. In FIG. 1, the image is formed in the order of yellow Y, magenta M, cyan C, and black K.

<Detailed Description of Data Control Section 201>

Figure 3:
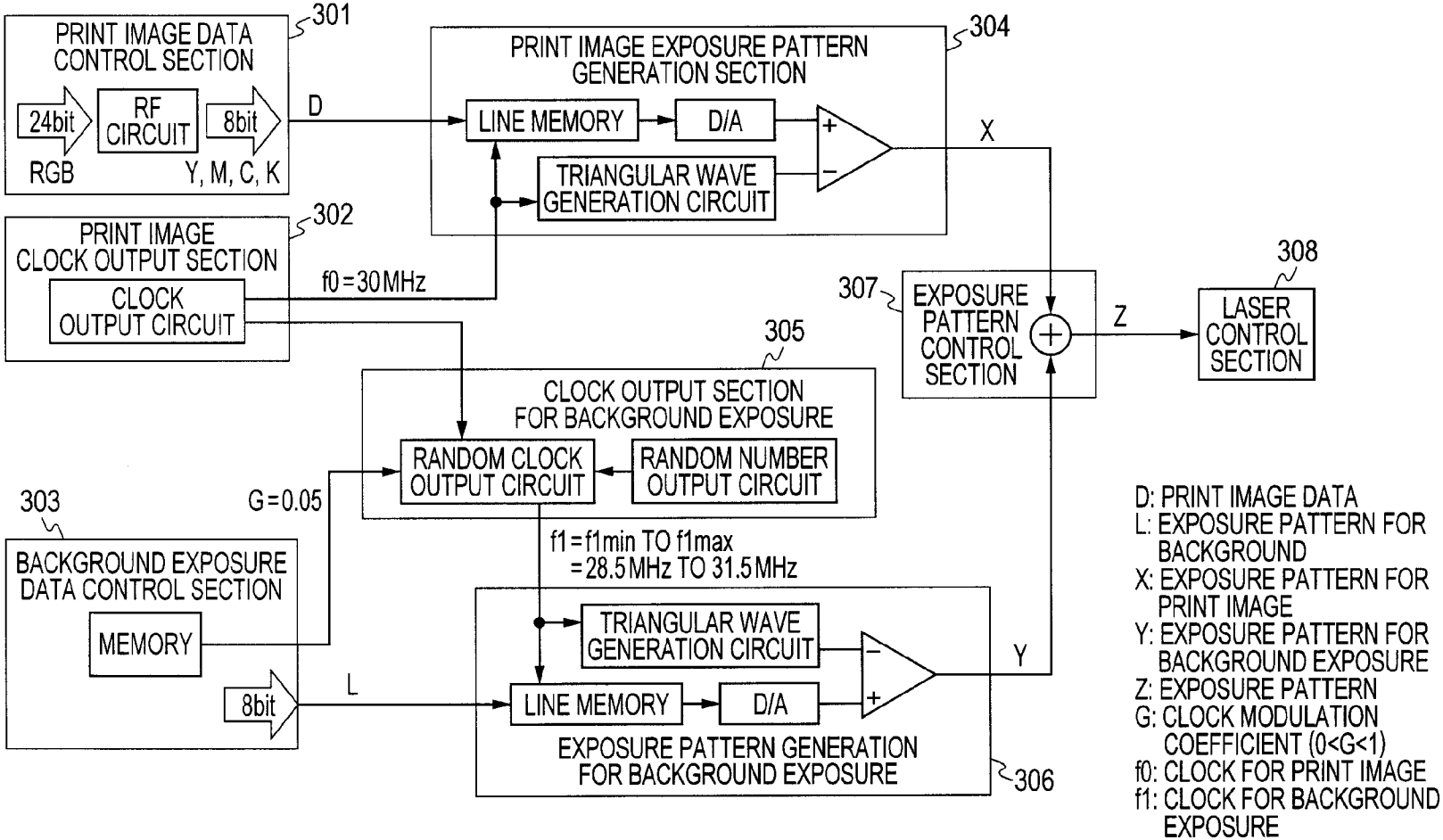
FIG. 3 is a block diagram depicting the detail of a data control section of the first embodiment.

FIG. 3 describes the detail of the data control section 201 of the present embodiment. A print image data control section 301 controls and manages the print data received through the host I/F section 202. A print image clock output section 302 (a second clock output unit) generates and outputs a print image clock f0. A background exposure data control section 303 controls and manages parameters for controlling background exposure. In the following description, "background" is referred to as "BG". Based on print image data D output from the print image data control section 301, a print image exposure pattern generation section 304 (exposure pattern generation unit) generates a print image exposure pattern X in synchronism with the print image clock f0. A BG exposure clock output section 305 (a first clock output unit) generates and outputs a clock for causing the light emitting element to slightly emit light for slight exposure (hereinafter referred to as a background exposure (BG exposure)) to a non-toner image forming region on the photosensitive drum 222. In the present invention, the slight exposure according to the present embodiment is defined by an exposure intensity as the potential amount on the photosensitive drum surface to be changed according to use of the background exposure, and as an exposure intensity low enough to prevent at least development (adherence) of toner. Based on the print image clock f0 and the BG exposure control parameter, the BG exposure clock output section 305 generates and outputs a BG exposure clock f1. An exposure pattern generation section 306 for BG exposure (slight exposure pattern generation unit) generates an exposure pattern Y for BG exposure. More specifically, based on BG exposure data L output from the BG exposure data control section 303, the exposure pattern generation section 306 for BG exposure generates the exposure pattern Y for BG exposure in synchronism with the BG exposure clock f1. Based on the print image exposure pattern X and the exposure pattern Y for BG exposure, an exposure pattern control section 307 controls a pattern for driving the light emitting element of the laser scanner 224. A laser control section 308 drives the laser scanner according to an exposure pattern Z output from the exposure pattern control section 307. The laser control section 308 is included in the drive control section 206 in FIG. 2.

<Description of Timing Chart>

Figure 4:
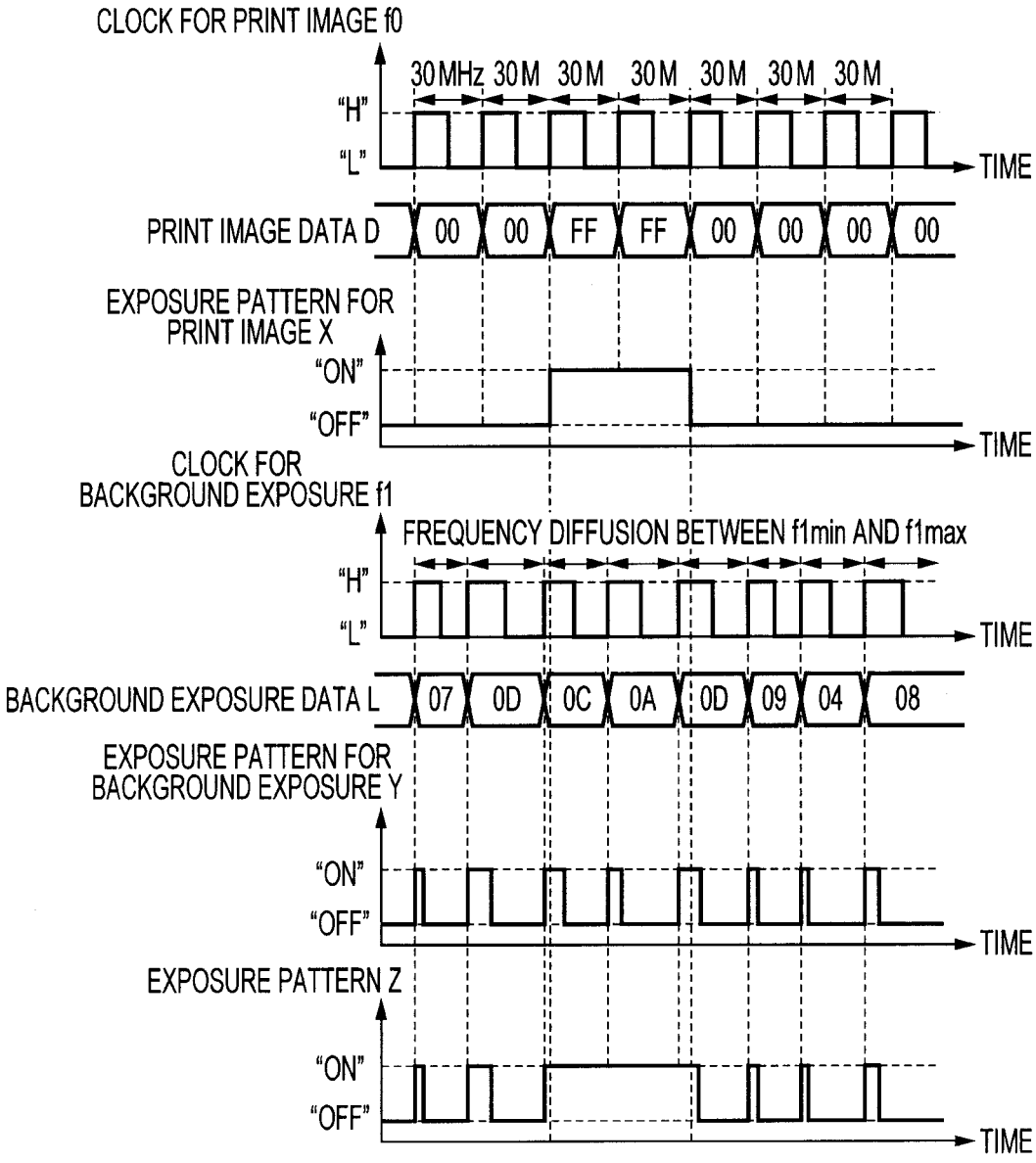
FIG. 4 is a timing chart of each signal of the first embodiment.

FIG. 4 is a timing chart of each signal of the present embodiment. In the timing chart, the print image clock f0 refers to a clock output from the print image clock output section 302. The print image data D refers to data output from the print image data control section 301. The print image exposure pattern X refers to a pattern generated by the print image exposure pattern generation section 304. The BG exposure clock f1 refers to a clock output from the BG exposure clock output section 305. The BG exposure data L refers to data output from the BG exposure data control section 303. The exposure pattern Y for BG exposure refers to a pattern generated by the exposure pattern generation section 306 for BG exposure. The exposure pattern Z refers to a pattern generated by the exposure pattern control section 307.

Now, the operation of the data control section 201 will be described in detail using FIGS. 3 and 4. The print image data control section 301 receives print data from the host I/F section 202, and outputs the print image data D to the print image exposure pattern generation section 304. In the present embodiment, as an example, 24-bit brightness data of R, G, and B output to a printer from the PC is color-converted to print image data D of yellow Y, magenta M, cyan C, and black K by an reproduction function (RF) circuit serving as a color conversion section. In the following description, the print image data D color-converted to Y, M, C, and K by the RF circuit is described as an 8-bit multivalued image signal illustrated as a data sequence in FIG. 4. Further, the RF circuit performs under color removal (UCR). In the present embodiment, each YMCK data output from the RF circuit is output in binary by halftone processing (image processing) in an unillustrated middle tone processing section. Then, the binary data (00h to FFh) of each YMCK data is output in binary as the print image data D. Thus, the print image data control section 301 also functions as the halftone processing section (image processing section).

The print image clock output section 302 uses a clock output circuit to generate the print image clock f0 to be output to the print image exposure pattern generation section 304 and the BG exposure clock output section 305. In the present embodiment, the following description assumes that as an example, the print image clock f0 output from the print image clock output section 302 is a rectangular wave expressed as follows.

$$f0=30\ [\mathrm{MHz}] \qquad \text{Formula (1-1)}$$

The exposure pattern is formed in synchronism with a rising edge. In addition, the following description assumes that the rising edge is valid (ON) in various rectangular waves, but apparently the system may be configured such that the falling edge is valid (ON).

Based on the print image data D received from the print image data control section 301, the print image exposure pattern generation section 304 generates the print image exposure pattern X synchronized with the print image clock f0. The print image exposure pattern generation section 304 stores the print image data D in a line memory, and reads the stored print image data D from the line memory in synchronism with the print image clock f0. The read print image data D is converted to an analog voltage by a D/A converter and then input to a positive input of a comparator at the next stage. An output signal from the triangular wave generation circuit is input to a negative input of the comparator. The triangular wave generation circuit uses an unillustrated integration circuit to convert the print image clock f0 to a triangular wave. From the comparator, a PWM signal synchronized with the rising edge timing of the print image clock f0 is output as the print image exposure pattern X.

The BG exposure data control section 303 controls and manages a clock modulation coefficient G and BG exposure data L which are BG exposure control parameters. The BG exposure data control section 303 outputs the clock modulation coefficient G to the BG exposure clock output section 305, and outputs the BG exposure data L to the exposure pattern generation section 306 for BG exposure.

In the present embodiment, the following description assumes that as an example, the clock modulation coefficient G is expressed as follows.

$$G=0.05\ (\text{where } 0<G<1.0) \qquad \text{Formula (1-2)}$$

The clock modulation coefficient G is stored in the memory 203. The BG exposure data L is used as an 8-bit multivalued image signal as data sequence in which a pulse width is randomly modulated as illustrated in FIG. 4.

Based on the print image clock f0 and the clock modulation coefficient G, the BG exposure clock output section 305 calculates a lower limit f1min and an upper limit f1max of the BG exposure clock f1 by the following calculation formula. Then, a random clock output circuit in the BG exposure clock output section 305 receives a random number from a random number output circuit, as well as the print image clock f0 and the clock modulation coefficient G. Thus, the random clock output circuit generates and outputs a BG exposure clock f1 subjected to random diffusion in a frequency range between the upper limit and the lower limit (in a predetermined frequency range). In other words, the BG exposure clock output section 305 diffuses the frequency of the BG exposure clock f1 causing a slight exposure in the vicinity of the frequency of the print image clock f0 output from the print image clock output section 302.

$$f1\min=f0\times(1-G) \qquad \text{Formula (1-3)}$$

$$f1\max=f0\times(1+G) \qquad \text{Formula (1-4)}$$

The example described in the present embodiment is calculated as follows.

$$f1\min = 30\ [\mathrm{MHz}]\times(1-0.05) = 28.5\ [\mathrm{MHz}] \qquad \text{Formula (1-5)}$$

$$f1\max = 30\ [\mathrm{MHz}]\times(1+0.05) = 31.5\ [\mathrm{MHz}] \qquad \text{Formula (1-6)}$$

Note that the information about the random frequency within the range between the upper and lower limits is preliminarily stored in a memory readable by the BG exposure clock output section 305, and then the random BG exposure clock may be output as needed. This applies to other embodiments described later.

Based on the BG exposure data L received from the BG exposure data control section 303, the exposure pattern generation section 306 for BG exposure generates an exposure pattern Y for BG exposure synchronized with the BG exposure clock f1. The exposure pattern generation section 306 for BG exposure stores the BG exposure data L in a line memory, and reads the stored BG exposure data L from the line memory in synchronism with the BG exposure clock f1. The read BG exposure data L is converted to an analog voltage by the D/A converter and then input to a positive input of a comparator at the next stage. An output signal from the triangular wave generation circuit is input to a negative input of the comparator. The triangular wave generation circuit uses an unillustrated integration circuit to convert the BG exposure clock f1 to a triangular wave. From the comparator, a PWM signal synchronized with the rising edge timing of the BG exposure clock f1 is output as the exposure pattern Y for BG exposure.

The exposure pattern control section 307 adds the print image exposure pattern X generated by the print image exposure pattern generation section 304 and the exposure pattern Y for BG exposure generated by the exposure pattern generation section 306 for BG exposure. The exposure pattern control section 307 outputs an exposure pattern Z to the laser control section 308. When the frequency of the print image exposure pattern X is higher (shorter ON time) than the frequency of the exposure pattern Y for BG exposure, the exposure pattern Y for BG exposure is input to the laser control section 308. When the frequency of the print image exposure pattern X is lower (longer ON time) than the frequency of the exposure pattern Y for BG exposure, the print image exposure pattern X is input to the laser control section 308. The laser control section 308 drives the laser scanner according to the exposure pattern Z output from the exposure pattern control section 307.

Figure 5A:
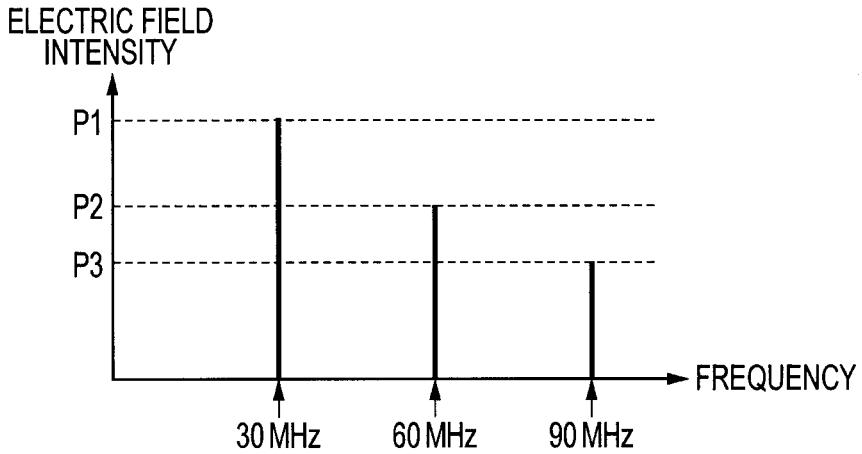
FIGS. 5A and 5B are graphs depicting an electric field intensity distribution of unnecessary radiation of a conventional embodiment for comparison with the first embodiment.

FIG. 5A are graphs depicting an electric field intensity distribution of unnecessary radiation of a conventional embodiment for comparison with the present embodiment. The BG exposure operation described in Description of the Related Art is such that an exposure pattern for BG exposure is generated based on the print image clock f0. FIG. 5A illustrates an electric field intensity distribution of unnecessary radiation, as an example of setting f0=30 [MHz]. The unnecessary radiation noise occurs as an electric field intensity distribution having peak intensities P1, P2, and P3 at 30 [MHz] which is the print image clock f0 which is an exposure period of the BG exposure, and 60 [MHz] and 90 [MHz] which are a multiple of the print image clock f0.

Figure 5B:
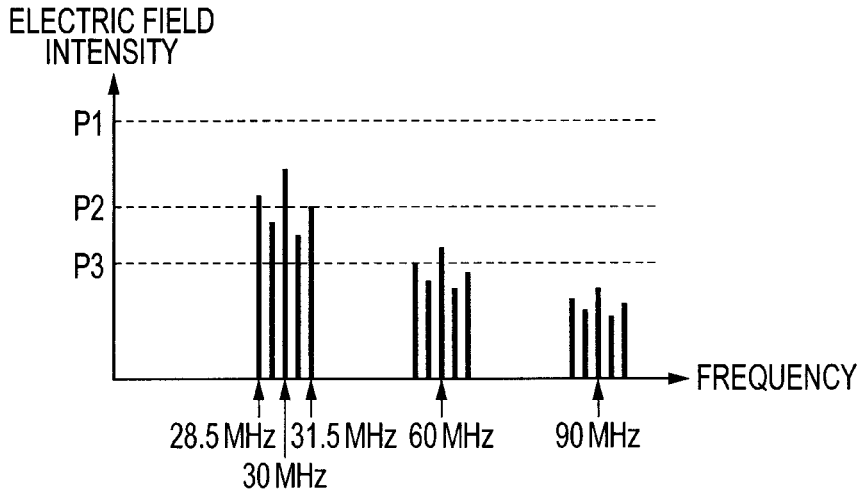

FIG. 5B describes the electric field intensity distribution of unnecessary radiation of the present embodiment. In the present embodiment, the following description assumes that as an example, the Formulae (1-1) to (1-6) described in FIG. 4 apply to the electric field intensity distribution of unnecessary radiation. The exposure period of the BG exposure is subjected to random diffusion in the range from f1min to f1max, and thus unnecessary radiation noise occurs as an electric field intensity distribution in which the BG exposure clock f1 is diffused from 28.5 [MHz] to 31.5 [MHz]. In the present embodiment, as illustrated in FIG. 5B, the electric field intensity distribution is diffused, and thus the peak values are smaller than the respective peak values of conventional single clock frequencies described in FIG. 5A.

In the conventional embodiment, modulation of the emission pulse width of the BG exposure reduces unnecessary radiation electric field intensity due to the emission time period width of the light emitting element. However, in the conventional embodiment, the total emission period of the emission time period and the non-emission time period of the BG exposure is always constant, and thus the electromagnetic field intensity occurring as unnecessary radiation due to the emission period is not necessarily reduced. In contrast to this, in the present embodiment, the BG exposure clock output section 305 generates and outputs the BG exposure clock f1 different from the print image clock f0. At this time, the BG exposure clock output section 305 outputs the BG exposure clock f1 by subjecting to frequency diffusion based on the print image clock f0. Thus, the present embodiment can provide an image forming apparatus reducing an electromagnetic field intensity occurring as unnecessary radiation. Note that the limit values of the electric field intensity distribution of unnecessary radiation are standardized by CISPR (International Special Committee on Radio Interference) such that the limit values of a low frequency are generally set lower than those of a high frequency. In other words, in some cases, it may be more important to reduce the electromagnetic field intensity occurring as unnecessary radiation due to the emission period than to reduce the electric field intensity of unnecessary radiation due to the emission time period width of light emitting element. The present embodiment is useful particularly in those cases.

As described above, the BG exposure clock f1 different from the print image clock f0 can be output. Further, the BG exposure clock f1 is generated and output by subjecting to random diffusion based on the print image clock f0. This configuration can provide an image forming apparatus reducing an electromagnetic field intensity occurring as unnecessary radiation. In other words, the present embodiment can reduce the electromagnetic field intensity occurring as unnecessary radiation by means of a simple configuration.

Second Embodiment

The following description will focus on the difference from the first embodiment. FIGS. 1 to 4 apply to the second embodiment in the same manner as to the first embodiment. The same reference numerals or characters as those in the first embodiment are used. In the first embodiment, the range of random diffusion of the BG exposure clock f1 is calculated based on the clock modulation coefficient G and the print image clock f0. In contrast to this, the present embodiment is characterized in that the calculation is based on the clock modulation coefficient G and the print image clock f0 in a plurality of print modes. Note that the print mode is determined based on, for example, information input from an unillustrated operation section by a user, information input from an external device through the host I/F section 202, or information detected by an unillustrated sensor detecting the type of the recording material 211. In general, the nip thickness of the fixing roller 232 varies depending on the material such as the type, the thickness and the like of the recording material 211 to be conveyed and thus the print mode such as the conveying speed of the recording material 211 needs to be switched. The scanning speed, the electrostatic latent image forming timing and the print image clock f0 need to be changed corresponding to the conveying speed for each print mode. The print image clock output section 302 of the present embodiment can output the print image clock f20 at a normal sheet mode and the print image clock f30 at a thick sheet mode. Note that the print image clock corresponding to each print mode is assumed to be preliminarily stored in the memory 203.

Figure 6A:
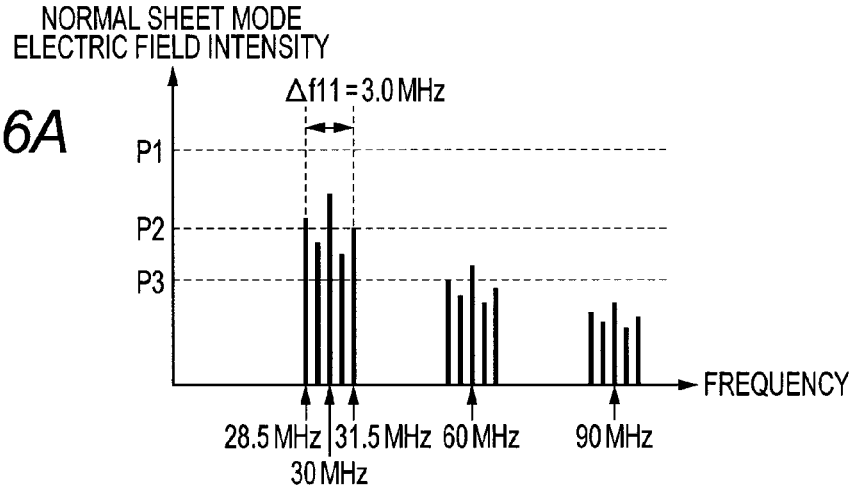
FIGS. 6A, 6B and 6C are graphs depicting the electric field intensity distribution of unnecessary radiation at each print mode of the first embodiment for comparison with a second embodiment.

FIG. 6A is a graph describing the electric field intensity distribution of unnecessary radiation at a normal sheet mode (a first print mode) of the first embodiment for comparison with the second embodiment. The following description assumes that in FIG. 6A, as an example, the print image clock f0 (clock for the first print mode) at the normal sheet mode is 30 [MHz]. The frequency diffusion operation of the BG exposure clock f1 is the same as described in FIGS. 3 and 4. The unnecessary radiation noise occurs as an electric field intensity distribution in which the BG exposure clock f1 is diffused from 28.5 [MHz] to 31.5 [MHz]. A diffusion frequency width Δf11 of the unnecessary radiation noise at this time is as follows.

$$\Delta f11 = 31.5\,[\mathrm{MHz}] - 28.5\,[\mathrm{MHz}] = 3.0\,[\mathrm{MHz}] \quad \text{Formula (2-1)}$$

Figure 6B:
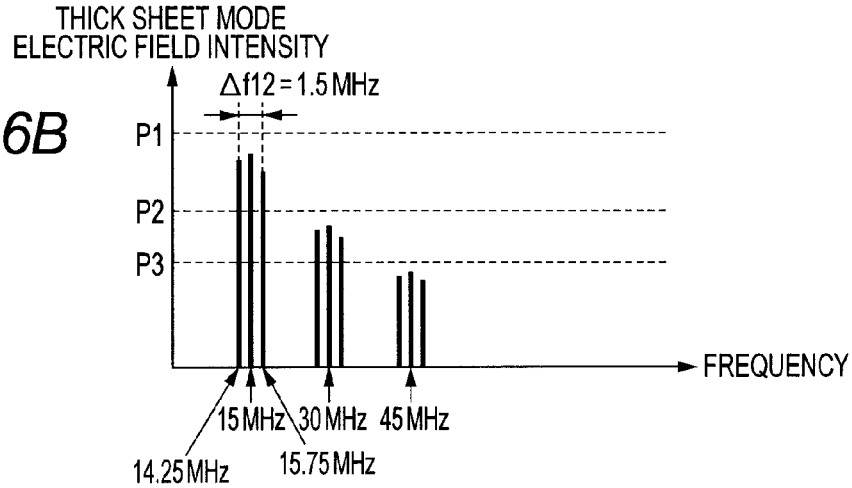

FIG. 6B is a graph describing the electric field intensity distribution of unnecessary radiation at a thick sheet mode (a second print mode) of the first embodiment for comparison with the second embodiment. The following description assumes that in FIG. 6B, as an example, the print image clock f0 (clock for the second print mode) at a thick sheet mode is 15 [MHz]. The frequency diffusion operation of the BG exposure clock f1 is the same as described in FIGS. 3 and 4. The lower limit f12min and the upper limit f12max of the BG exposure clock f1 at the thick sheet mode are calculated as follows.

$$f12\mathrm{min} = f0 \times (1 - G) \quad \text{Formula (2-2)}$$

$$= 15\,[\mathrm{MHz}] \times (1 - 0.05) = 14.25\,[\mathrm{MHz}] \quad \text{Formula (2-3)}$$

$$f12\mathrm{max} = f0 \times (1 + G) \quad \text{Formula (2-4)}$$

$$= 15\,[\mathrm{MHz}] \times (1 + 0.05) = 15.75\,[\mathrm{MHz}] \quad \text{Formula (2-5)}$$

A diffusion frequency width Δf12 of the unnecessary radiation noise at this time is as follows.

$$\Delta f12 = f12\max - f12\min \quad \text{Formula (2-6)}$$

$$= 15.75\,[\text{MHz}] - 14.25\,[\text{MHz}]$$

$$= 1.5\,[\text{MHz}] \quad \text{Formula (2-7)}$$

Consequently, when the random diffusion range of the BG exposure clock f1 is calculated based on the print image clock f0 and the clock modulation coefficient G, the unnecessary radiation noise reduction effect at the thick sheet mode is smaller than the unnecessary radiation noise reduction effect at the normal sheet mode.

Now, the operation of the present embodiment will be described. The following description assumes that in the present embodiment, as an example, the print image clock at the normal sheet mode is f20=30 [MHz], and the print image clock at the thick sheet mode is f30=15 [MHz]. In FIG. 3, at the normal sheet mode, based on the print image clock f20 and the clock modulation coefficient G, the BG exposure clock output section 305 calculates the lower limit f21min and the upper limit f21max of the BG exposure clock f21 by the following calculation formula. The random clock output circuit in the BG exposure clock output section 305 receives a random number from the random number output circuit, as well as the print image clock f20 and the clock modulation coefficient G. Thus, the random clock output circuit generates and outputs a BG exposure clock f21 subjected to random diffusion in a frequency range between the upper limit and the lower limit.

$$f2\min = f20 \times (1 - G \times f20/f20) \quad \text{Formula (2-8)}$$

$$f2\max = f20 \times (1 + G \times f20/f20) \quad \text{Formula (2-9)}$$

In the example described in the present embodiment, the calculation is performed as follows.

$$f21\min = 30\,[\text{MHz}] \times (1 - 0.05 \times 30/30) \quad \text{Formula (2-10)}$$

$$= 28.5\,[\text{MHz}] \quad \text{Formula (2-11)}$$

$$f21\max = 30\,[\text{MHz}] \times (1 + 0.05 \times 30/30) \quad \text{Formula (2-12)}$$

$$= 31.5\,[\text{MHz}] \quad \text{Formula (2-13)}$$

The diffusion frequency width Δf21 of the unnecessary radiation noise at this time is calculated as follows.

$$\Delta f21 = f21\max - f21\min \quad \text{Formula (2-14)}$$

$$= 31.5\,[\text{MHz}] - 28.5\,[\text{MHz}]$$

$$= 3.0\,[\text{MHz}] \quad \text{Formula (2-15)}$$

Now, the operation at the thick sheet mode will be described in detail. In FIG. 3, at the thick sheet mode, the BG exposure clock output section 305 generates and outputs the BG exposure clock f22 as follows. More specifically, based on the print image clock f20 at the normal sheet mode and the print image clock f30 at the thick sheet mode as well as the clock modulation coefficient G, the BG exposure clock output section 305 calculates the lower limit f22min and the upper limit f22max of the BG exposure clock by the following calculation formula. The random clock output circuit in the BG exposure clock output section 305 generates and outputs a BG exposure clock f22 subjected to random diffusion in a frequency range between the upper limit and the lower limit. More specifically, at each of the normal sheet mode or the thick sheet mode, the BG exposure clock output section 305 diffuses the clock frequency at the thick sheet mode at a frequency in the vicinity of the print image clock f0 at the normal sheet mode or in the vicinity of the print image clock f0 at the thick sheet mode.

$$f22\min = f30 \times (1 - G \times f20/f30) \quad \text{Formula (2-16)}$$

$$f22\max = f30 \times (1 + G \times f20/f30) \quad \text{Formula (2-17)}$$

Figure 6C:
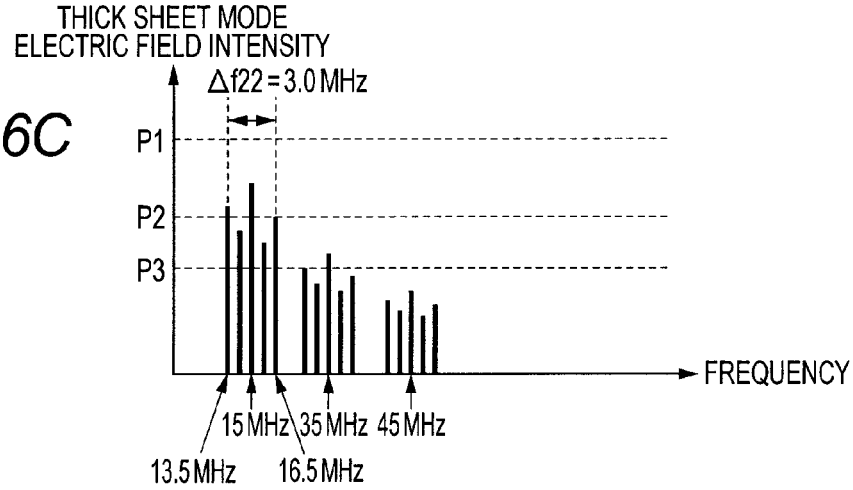

FIG. 6C describes the electric field intensity distribution of unnecessary radiation at the thick sheet mode according to the present embodiment. In the example described in the present embodiment, the calculation is performed as follows.

$$f22\min = 15\,[\text{MHz}] \times (1 - 0.05 \times 30/15) \quad \text{Formula (2-18)}$$

$$= 13.5\,[\text{MHz}] \quad \text{Formula (2-19)}$$

$$f22\max = 15\,[\text{MHz}] \times (1 + 0.05 \times 30/15) \quad \text{Formula (2-20)}$$

$$= 16.5\,[\text{MHz}] \quad \text{Formula (2-21)}$$

The diffusion frequency width Δf22 of the unnecessary radiation noise at this time is calculated as follows.

$$\Delta f22 = f22\max - f22\min \quad \text{Formula (2-22)}$$

$$= 16.5\,[\text{MHz}] - 13.5\,[\text{MHz}]$$

$$= 3.0\,[\text{MHz}] \quad \text{Formula (2-23)}$$

The diffusion frequency width Δf22 is the same as the diffusion frequency width Δf21 at the normal sheet mode.

As described above, the present embodiment can output the BG exposure clock different from the print image clock by varying the BG exposure clock for each print mode. Further, the present embodiment can output the frequency of the BG exposure clock subjected to diffusion based on the clock modulation coefficient and the print image clocks at a plurality of print modes. Thus, the present embodiment can provide an image forming apparatus reducing an electromagnetic field intensity occurring as unnecessary radiation regardless of the difference in a plurality of print modes. In other words, the present embodiment can reduce the electromagnetic field intensity occurring as unnecessary radiation by means of a simple configuration for each print mode even in an image forming apparatus operable at a plurality of print modes.

Third Embodiment

The following description will focus on the difference from the first and second embodiments. FIGS. 1 to 5B and 6C apply to the third embodiment in the same manner as to the first and the second embodiments. The same reference numerals or characters as those in the first and second embodiments are used. In the first and second embodiments, random diffusion is used as the frequency diffusion of the BG exposure clock. In contrast to this, the present embodiment is characterized by using sweep diffusion. Note that the sweep diffusion refers to diffusion by sweeping all frequencies in a desired range. The random diffusion may involve a deviation of the clock frequency after modulation and insufficient diffusion of the electric field intensity distribution.

Figure 7A:
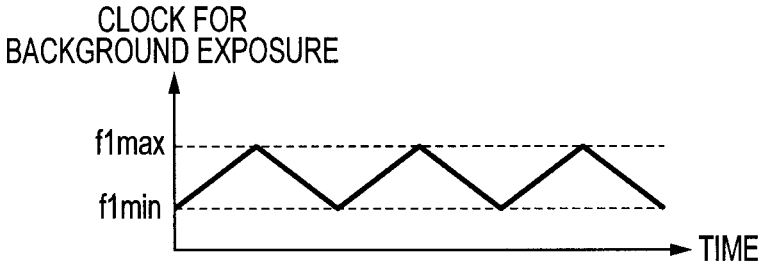
FIGS. 7A and 7B are graphs depicting sweep diffusion of a third embodiment and the electric field intensity distribution of unnecessary radiation.

FIG. 7A is a graph describing the detail of the sweep diffusion according to the present embodiment. In FIG. 3, the BG exposure clock output section 305 calculates the lower limit f1min and the upper limit f1max of the BG exposure clock. Here, the BG exposure clock output section 305 of the present embodiment has a sweep clock output circuit corresponding to the random clock output circuit illustrated in FIG. 3. The sweep clock output circuit in the BG exposure clock output section 305 generates the BG exposure clock f1 subjected to sweep diffusion in a frequency range between the upper limit and the lower limit. The generated BG exposure clock is subjected to sweep diffusion in the range from f1min to f1max as illustrated in FIG. 7A.

Figure 7B:
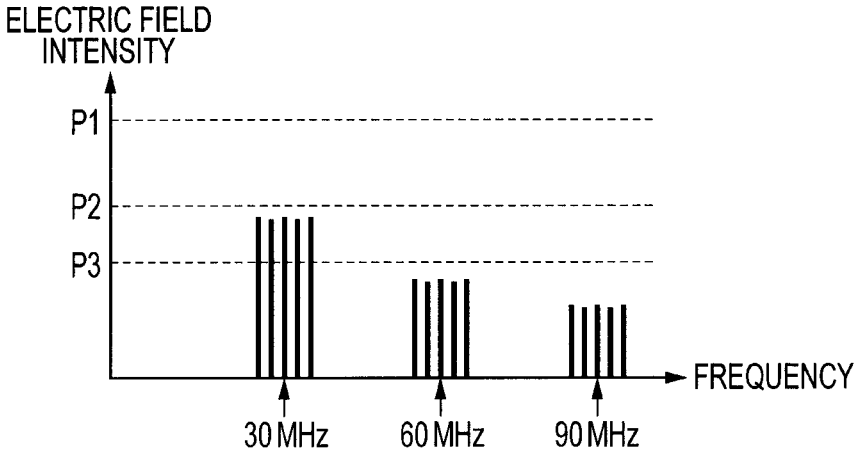

FIG. 7B is a graph describing the electric field intensity distribution of unnecessary radiation according to the present embodiment. As described in FIG. 7A, the Exposure period of the BG exposure is subjected to sweep diffusion in the range from f1min to f1max, and thus unnecessary radiation noise occurs as an electric field intensity distribution in which the unnecessary radiation noise is evenly distributed in the range from f1min to f1max.

As described above, the present embodiment can output the BG exposure clock different from the print image clock. Further, the present embodiment can output the BG exposure clock subjected to sweep diffusion based on the print image clock. Thus, the present embodiment can provide an image forming apparatus evenly reducing an electromagnetic field intensity occurring as unnecessary radiation. In other words, the present embodiment can reduce the electromagnetic field intensity occurring as unnecessary radiation by means of a simple configuration.

Fourth Embodiment

The following description will focus on the difference from the first to third embodiments. FIGS. 1 to 7 apply to the fourth embodiment in the same manner as to the first to third embodiments. The same reference numerals or characters as those in the first to third embodiments are used.

In the first to third embodiments, the exposure pattern control section 307 generates the exposure pattern Z as follows. That is, the exposure pattern control section 307 combines the print image exposure pattern X generated by the print image exposure pattern generation section 304 and the exposure pattern Y for BG exposure (slight exposure pattern) generated by the exposure pattern generation section 306 for BG exposure. The present embodiment has an exposure pattern correction section 1102 (FIG. 9) for BG exposure correcting the exposure pattern Y for BG exposure based on a print image exposure pattern X'. The exposure pattern control section 307 is characterized by combining the print image exposure pattern X generated by the print image exposure pattern generation section 304 and the exposure pattern R for BG exposure (FIG. 9) corrected by the exposure pattern correction section 1102 for BG exposure.

Figure 8:
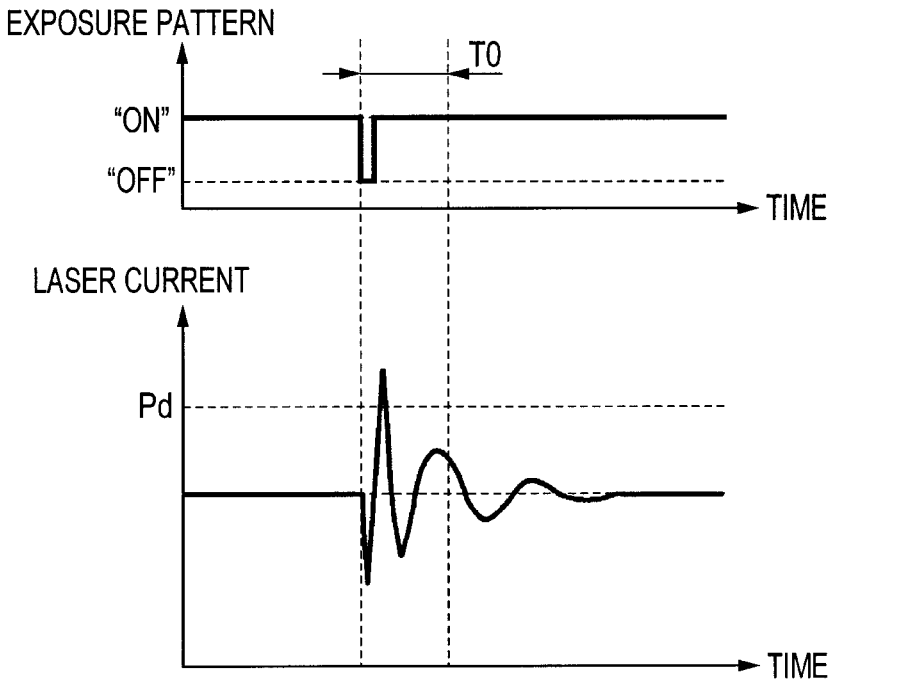
FIG. 8 is a graph depicting current flowing through a light emitting element of a fourth embodiment.

FIG. 8 is a graph describing current flowing through a light emitting element of the present embodiment. T0 refers to a minimum ensured time of turning-off of a light emitting element (minimum ensured time of turning-off of laser). Pd refers to a maximum rated value of a current applied to a light emitting element (maximum rated value of laser current). In general, when the light emitting element of the laser scanner 224 is turned on again immediately after the light emitting element is turned off for a time shorter than the minimum ensured time T0 for turning-off, overshoot and undershoot may occur in a current applied to the light emitting element depending on the circuit conditions on the drive circuit side (see FIG. 8). In such a case, a current exceeding the maximum rated value Pd of applied current is applied to the light emitting element, which may cause deterioration or damage of the light emitting element.

Figure 9:
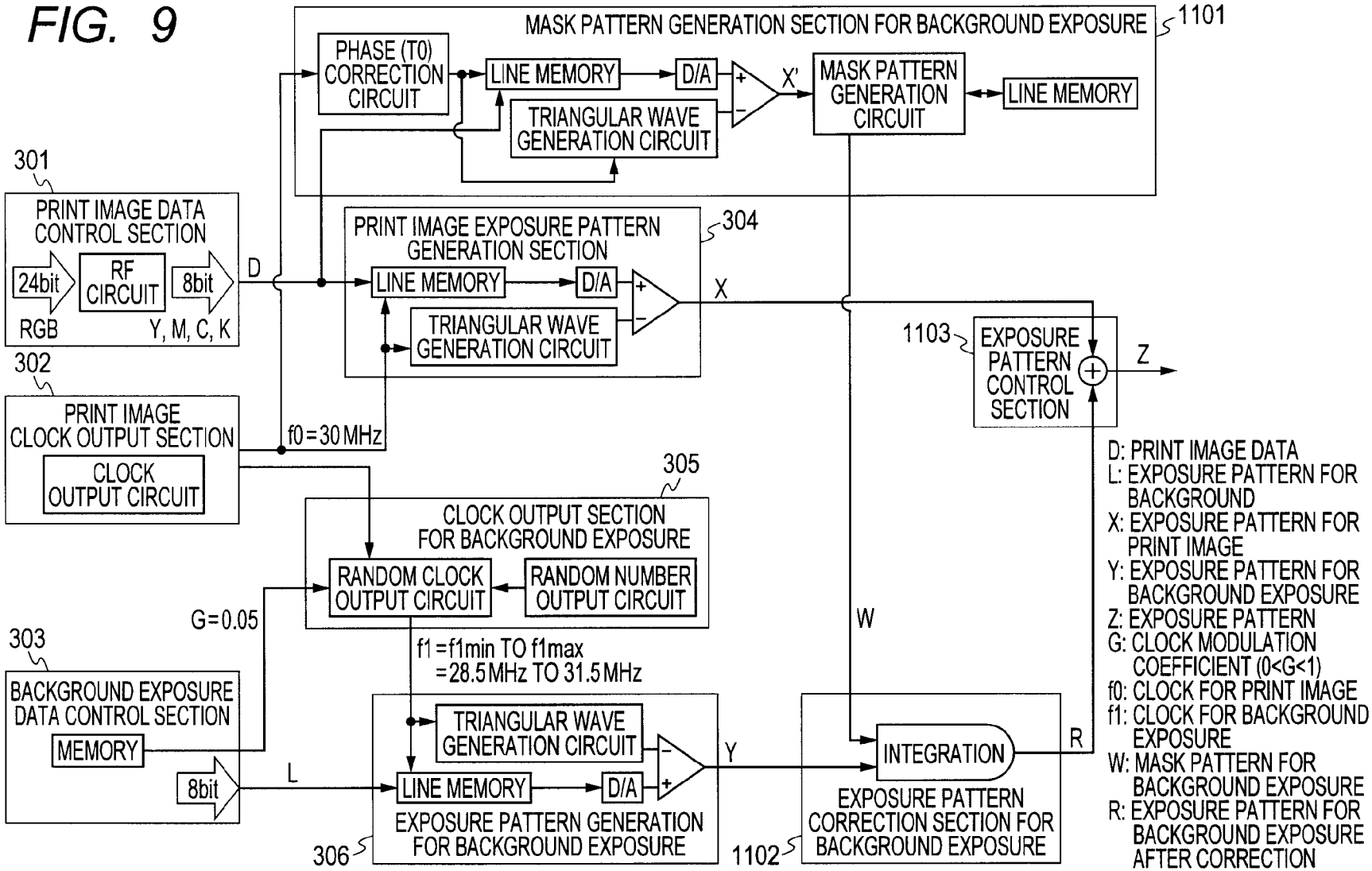
FIG. 9 is a block diagram depicting the detail of a data control section of the fourth embodiment.

Now, the operation of the present embodiment will be described. FIG. 9 is a block diagram describing the entire data control section 201 of the present embodiment. The print image data control section 301, the print image clock output section 302, the BG exposure data control section 303, and the print image exposure pattern generation section 304 operate in the same manner as in FIG. 3. In addition, the BG exposure clock output section 305, the exposure pattern generation section 306 for BG exposure, and the laser control section 308 also operate in the same manner as in FIG. 3.

A BG exposure mask pattern generation section 1101 (mask pattern generation unit) generates a BG exposure mask pattern W. Based on the BG exposure mask pattern W output from the BG exposure mask pattern generation section 1101, a exposure pattern correction section 1102 (correction unit) for BG exposure corrects the exposure pattern Y for BG exposure. Based on the print image exposure pattern X and the exposure pattern R for BG exposure after correction output from the exposure pattern correction section 1102 for BG exposure, the exposure pattern control section 1103 controls the pattern for driving the light emitting element of the laser scanner 224.

Figure 10:
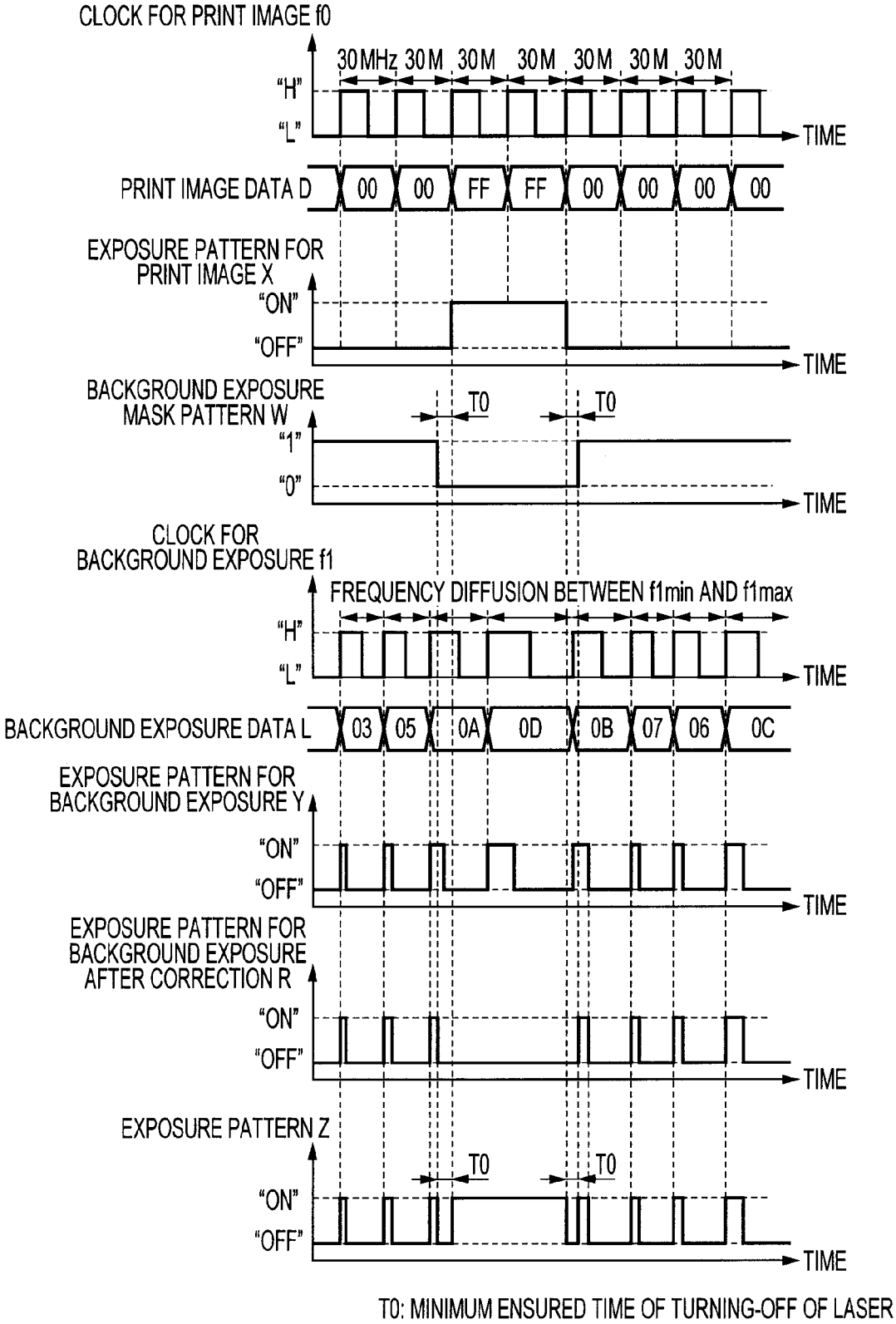
FIG. 10 is a timing chart of each signal of the fourth embodiment.

FIG. 10 is a timing chart of each signal of the present embodiment. The print image clock f0, the print image data D, the print image exposure pattern X, the BG exposure clock f1, the BG exposure data L, and exposure pattern Y for BG exposure are the same as those in FIG. 4. The BG exposure mask pattern W is generated by the BG exposure mask pattern generation section 1101. The exposure pattern R for BG exposure after correction is corrected by the exposure pattern correction section 1102 for BG exposure.

Now, the operation of the data control section 201 will be described in detail using FIGS. 9 and 10. The BG exposure mask pattern generation section 1101 receives the print image data D from the print image data control section 301 and temporarily stores the print image data D in a line memory. The BG exposure mask pattern generation section 1101 sequentially reads the print image data D stored in the line memory to output the data D to a mask pattern generation circuit. Based on the print image data D, the mask pattern generation circuit generates a BG exposure mask pattern W.

Specifically, the print image data D output from the print image data control section 301 is input. The print image clock f0 output from the print image clock output section 302 is input to the BG exposure mask pattern generation section 1101. Then, the phase correction circuit advances the phase of the input clock by T0 seconds (predetermined time). The clock whose phase is advanced by the phase correction circuit is input to the line memory and the triangular wave generation circuit.

Then, the BG exposure mask pattern generation section 1101 reads the print image data D from the line memory in synchronism with the clock whose phase is advanced by T0 seconds. The print image data D is converted to an analog voltage by the D/A converter and then input to a positive input of a comparator at the next stage. Meanwhile, an output signal from the triangular wave generation circuit is input to a negative input of the comparator. Then, a print image exposure pattern X' is output. The operation of the comparator is the same as that of the comparator outputting the print image exposure pattern X in the print image exposure pattern generation section 304 described in FIG. 4 except that the output timing of the print image exposure pattern X' advances by T0 seconds. Then, the mask pattern generation circuit determines whether or not the input print image exposure pattern X' contains ON data (a first determination). Here, time T0 refers to the minimum ensured time of turning-off of the light emitting element of the laser scanner 224 described in FIG. 8 and a parameter controlled and managed by the data control section 201. In addition, the mask pattern generation circuit stores the input print image exposure pattern X' in a line memory. Then, the mask pattern generation circuit determines whether or not the print image exposure pattern X' that has been stored in the line memory for 2×T0 seconds contains ON data (a second determination). When at least one of the first determination and the second determination is made such that ON data is contained, the mask pattern generation circuit outputs "0" as the BG exposure mask pattern W. Consequently, the BG exposure mask pattern generation section 1101 generates the mask pattern before the rising edge of the print image exposure pattern X by a predetermined time and after the falling edge of the print image exposure pattern by a predetermined time. Note that if the system is configured such that the falling edge is valid, the mask pattern is generated before the falling edge of the print image exposure pattern X by a predetermined time and after the rising edge of the print image exposure pattern by a predetermined time. When the predetermined time is set shorter than the period of the clock output from the print image clock output section 302, the slight exposure period can be increased to a maximum.

Meanwhile, when both the first determination and the second determination are made such that ON data is not contained, the mask pattern generation circuit outputs "1" as the BG exposure mask pattern W. As a result, the BG exposure mask pattern W is "0" only at a timing when the print image exposure pattern is on or off and at the time T0 before and after the timing.

Here, a variation of the second determination will be described. A clock f0 whose phase is delayed by T0 seconds is generated. In synchronism with the clock f0, the BG exposure mask pattern generation section 1101 reads the print image data D from the line memory. The print image data D may be converted to an analog voltage by the D/A converter and then input to a positive input of a comparator at the next stage. Then, a determination is made real time as to whether or not the output print image exposure pattern X' contains ON data. Thereby, the second determination can be made by the BG exposure mask pattern generation section 1101.

The exposure pattern correction section 1102 for BG exposure corrects a pattern based on the following two patterns and outputs the corrected pattern to the exposure pattern control section 1103. Specifically, the exposure pattern correction section 1102 for BG exposure integrates and corrects the exposure pattern Y for BG exposure generated by the exposure pattern generation section 306 for BG exposure and the BG exposure mask pattern W generated by the BG exposure mask pattern generation section 1101. Then, the exposure pattern correction section 1102 for BG exposure outputs the corrected exposure pattern R for BG exposure after correction to the exposure pattern control section 1103.

The exposure pattern control section 1103 adds (combines) the print image exposure pattern X generated by the print image exposure pattern generation section 304 and the exposure pattern R for BG exposure after correction corrected by the exposure pattern correction section 1102 for BG exposure. Then, the exposure pattern control section 1103 outputs the exposure pattern Z to the laser control section 308. The laser control section 308 drives the laser scanner 224 according to the exposure pattern Z input from the exposure pattern control section 1103 as described hereinbefore. According to the exposure pattern Z, the non-emission time period of the light emitting element of the laser scanner 224 is longer than the minimum ensured time T0 of turning-off thereof. Accordingly, the present embodiment can prevent occurrence of overshoot and undershoot in a current applied to the light emitting element while subjecting the BG exposure clock f1 to random diffusion. Note that in the present embodiment, the frequency diffusion of the BG exposure clock f1 is random diffusion, but may be sweep diffusion like the third embodiment.

As described hereinbefore, the present embodiment is configured to have the exposure pattern correction section 1102 for BG exposure correcting the exposure pattern Y for BG exposure based on the print image exposure pattern X. Further, the exposure pattern control section 1103 combines the print image exposure pattern X generated by the print image exposure pattern generation section 304 and the exposure pattern R for BG exposure after correction corrected by the exposure pattern correction section 1102 for BG exposure. Thus, the present embodiment can prevent occurrence of overshoot and undershoot in a current applied to the light emitting element while providing an image forming apparatus reducing the electromagnetic field intensity occurring as unnecessary radiation. In other words, the present embodiment can reduce the electromagnetic field intensity occurring as unnecessary radiation by means of a simple configuration.

Fifth Embodiment

In the first to fourth embodiments, substantially binarized YMCK data (00h to FFh) has been described as the print image data D. However, multivalued data may be used as the print image data D.

Figure 11:
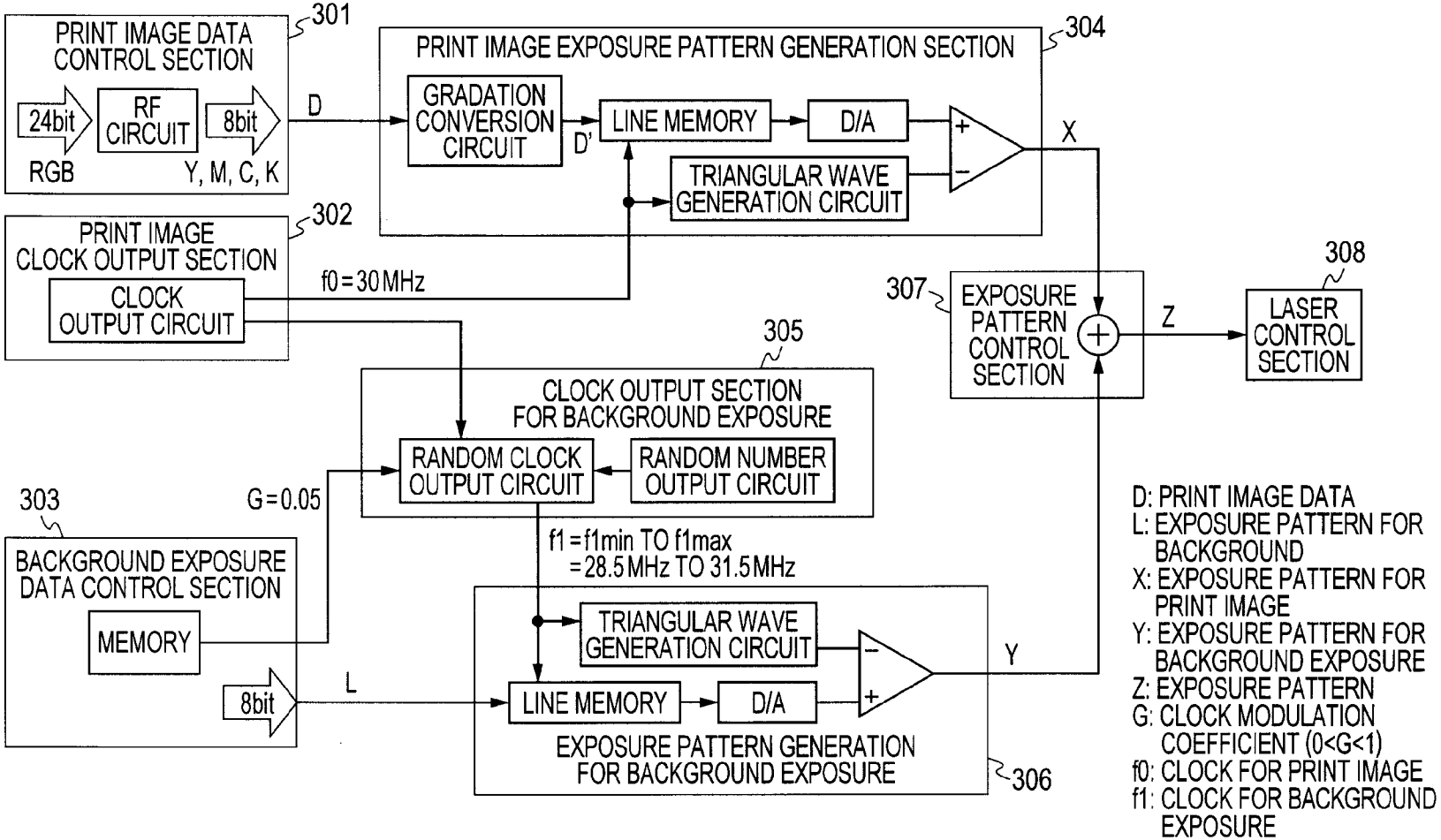
FIG. 11 is a block diagram depicting the detail of a data control section of a fifth embodiment.

FIG. 11 is a block diagram describing the detail of the data control section 201 of the present embodiment. The following description will focus on the difference from FIG. 3. First, an unillustrated middle tone processing section performs halftone processing to output multivalued print image data D for each YMCK. In the present embodiment, for example, multivalued data (multivalued image data) expressed as an 8-bit width can be adopted. The print image exposure pattern generation section 304 has a gradation conversion circuit subjecting the print image data D to gradation conversion. The gradation conversion circuit performs gradation conversion on a gradation value of the input print image data D. Then, the print image exposure pattern generation section 304 stores the converted print image data D' in a line memory. FIG. 11 is effective in a case in which occurrence of overshoot and undershoot in a current applied to the light emitting element described in the fourth embodiment is not substantially problematic or can be ignored.

Figure 12:
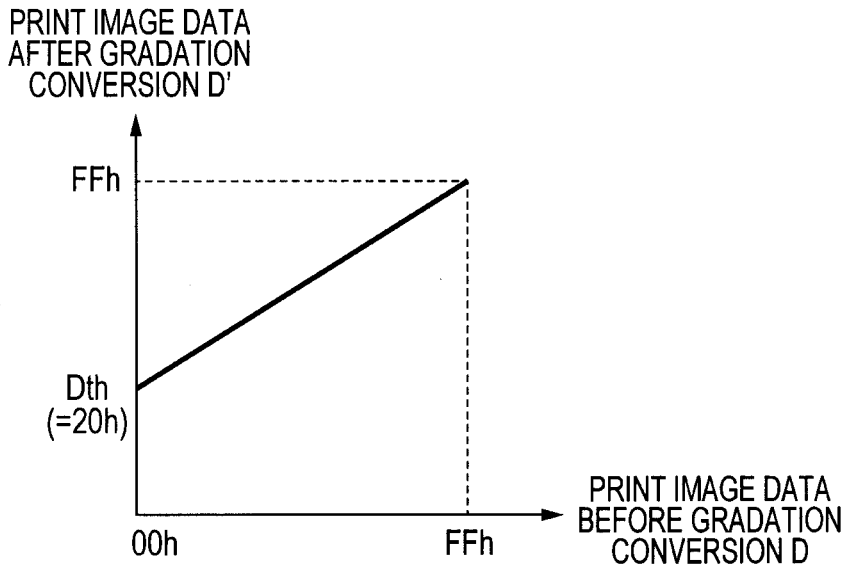
FIG. 12 is a graph depicting gradation conversion of print image data of the fifth embodiment.

FIG. 12 is a graph describing gradation conversion of the print image data D. A gradation value of the print image data D from 00[h] to FF[h] defined by 8 bits is converted to a gradation value from Dth[h] (predetermined value) to FF[h] to generate multivalued image data after conversion. More specifically, the print image exposure pattern generation section 304 allocates a gradation value of Dth[h] or more to the print image data D and sets the emission time period of the print image exposure pattern X to the predetermined value or more. Here, the Dth refers to image data corresponding to a minimum exposure amount (minimum emission time period) small enough to form a toner image on a photosensitive member. Note that laser emission with a pulse width corresponding to a gradation value smaller than the Dth[h] provides a short emission time period (small exposure amount) which is not enough to form an electrostatic latent image allowing toner to adhere to a photosensitive drum surface.

More specifically, the BG exposure data L having a gradation value less than Dth[h] is input to the exposure pattern generation section 306 for BG exposure, and the width of the exposure pattern Y for BG exposure is limited to an emission time period (time shorter than the predetermined value) short enough not to allow toner to adhere. Note that the value of Dth may be variable according to various parameters such as the service life of the photosensitive drum 222. Note also that the print image data D' is not limited to a linear relationship as long as the print image data D' is determined based on the print image data D. In the present embodiment, as an example, Dth=20[h] is used.

Figure 13:
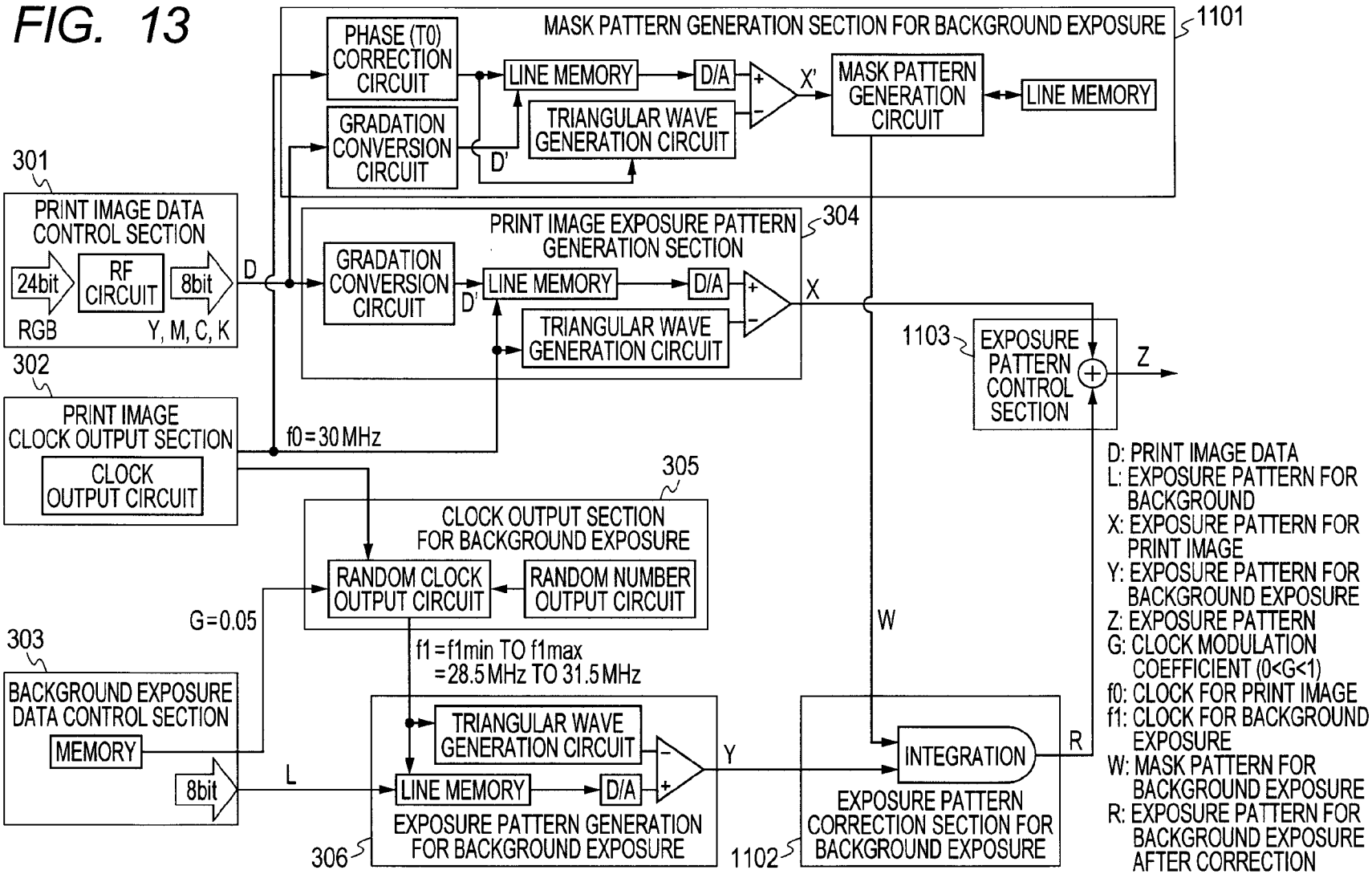
FIG. 13 is another block diagram depicting the detail of the print image data of the fifth embodiment.

FIG. 13 is block diagram describing another detail of the data control section 201 of the present embodiment. FIG. 13 corresponds to the problem with overshoot and undershoot occurring in a current applied to the light emitting element described in the fourth embodiment.

Figure 14:
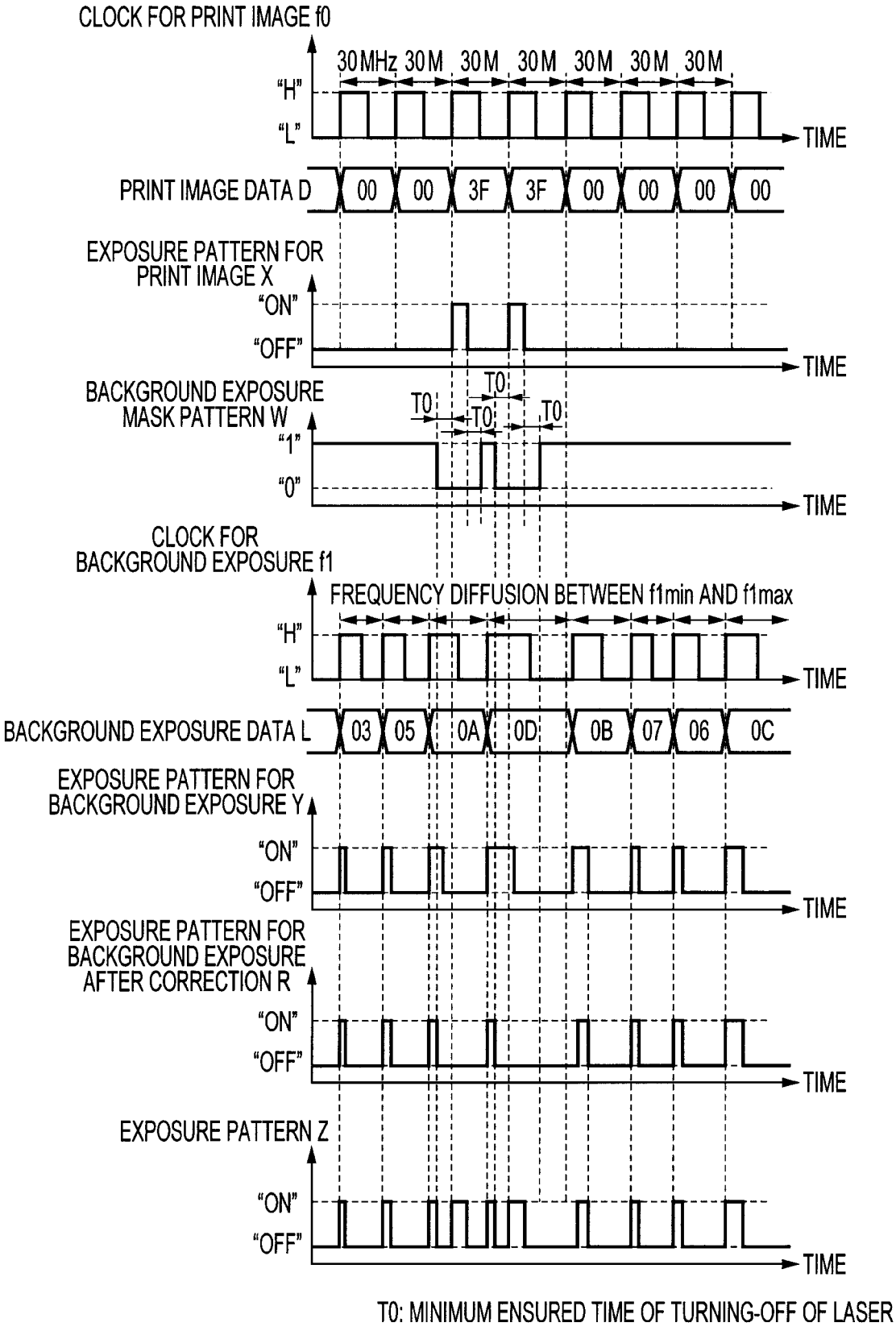
FIG. 14 is a timing chart of each signal of the fifth embodiment.
Figure 15A:
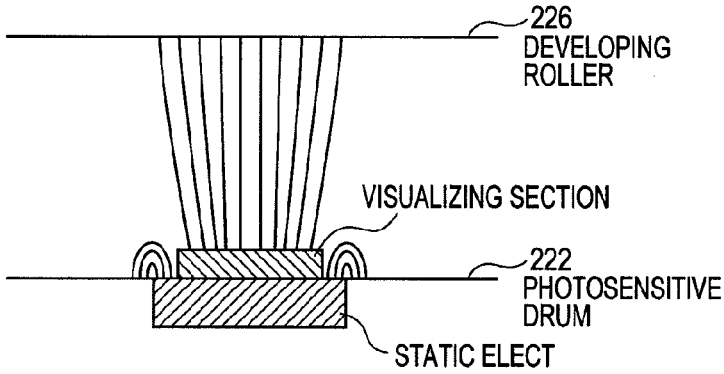
FIG. 15A PRIOR ART
FIGS. 15A and 15B are a graph depicting a white gap, an exposure pattern, and an electric field intensity distribution of unnecessary radiation noise of a conventional embodiment.
Figure 15B:
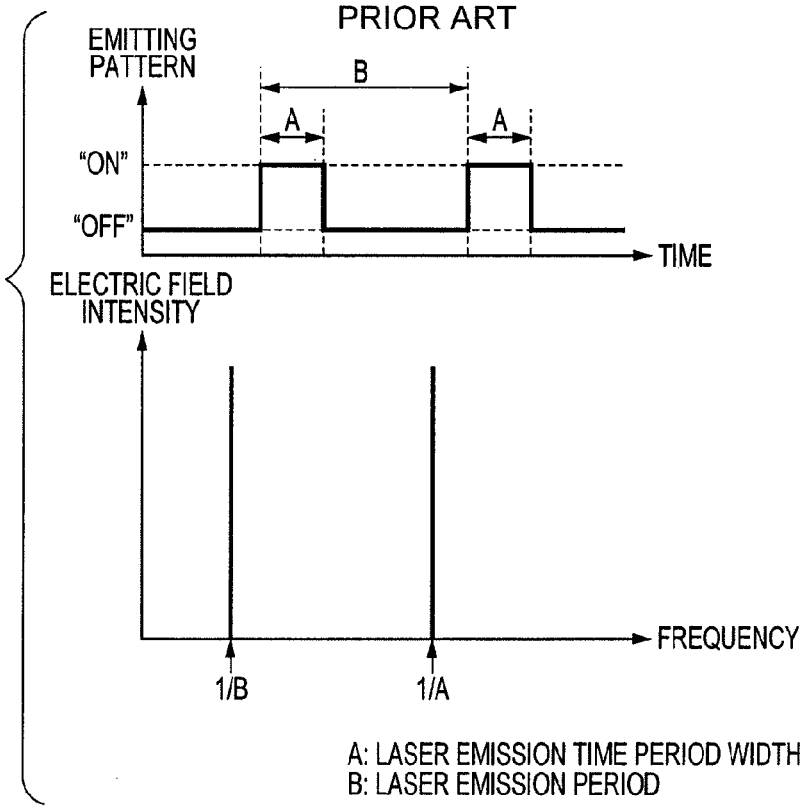
FIG. 15B PRIOR ART

In FIG. 13, the BG exposure mask pattern generation section 1101 also has a gradation conversion circuit. The gradation conversion circuit performs gradation conversion on the print image data D. Then, the converted print image data D' is temporarily stored in a line memory. The operation of the present embodiment is the same as that described in the fourth embodiment. Specifically, the BG exposure mask pattern generation section 1101 sequentially reads the print image data D' stored in the line memory to output the print image data D' to the mask pattern generation circuit. Based on the print image data D', the mask pattern generation circuit generates the BG exposure mask pattern W. FIG. 14 is a timing chart including the BG exposure mask pattern W.

Specifically, the present embodiment is the same as the fourth embodiment in that the output timing of the print image exposure pattern X' advances by T0 seconds, and the mask pattern generation circuit determines whether or not the input print image exposure pattern X' contains ON data (a first determination). In addition, the present embodiment is also the same as the fourth embodiment in that the mask pattern generation circuit stores the input print image exposure pattern X' in the line memory and determines whether or not the print image exposure pattern X' that has been stored in the line memory for 2×T0 seconds contains ON data (a second determination). Further, the present embodiment is also the same as the fourth embodiment in that the BG exposure mask pattern W is generated based on the above determination.

Thus, even in the case of using multivalued data as the print image data D, the present embodiment can provide an image forming apparatus reducing the electromagnetic field intensity occurring as unnecessary radiation. Further, even in the case of using multivalued data as the print image data D, the present embodiment can prevent occurrence of overshoot and undershoot in a current applied to the light emitting element while providing an image forming apparatus reducing the electromagnetic field intensity occurring as unnecessary radiation. In other words, the present embodiment can reduce the electromagnetic field intensity occurring as unnecessary radiation by means of a simple configuration.

FIGS. 11 and 13 have been described such that a gradation conversion circuit is provided in the print image exposure pattern generation section 304, but apparently the gradation conversion circuit may be provided in the print image data control section 301. Thus, a variation of the data control section 201 may exert the same effect.

Sixth Embodiment

The first to fourth embodiments have been described such that the BG exposure clock output section 305 outputs the BG exposure clock based on the input print image clock f0, the clock modulation coefficient G, and the output from the random number output circuit or the sweep clock output circuit, but the present invention is not limited to these embodiments and can be applied to various embodiments.

For example, if the print image clock f0 is known in advance, the BG exposure clock described in each of the above embodiments is calculated in advance by an external computer or the data control section 201. Then, for example, a plurality of random frequencies contained in the range between the lower limit and the upper limit of the calculated BG exposure clock is preliminarily stored in the memory 203. Then, the BG exposure clock output section 305 may sequentially read and output the frequencies.

The second embodiment has been described such that the lower limit and the upper limit of the BG exposure clock are calculated for each print mode, but a plurality of random frequencies contained in the range between the lower limit and the upper limit of the BG exposure clock may be preliminarily stored for each print mode. Then, the BG exposure clock output section 305 may sequentially read and output the plurality of random frequencies contained in the range between the lower limit and the upper limit stored for each print mode. Note that the BG exposure clock output section 305 may identify the print mode such that a signal indicating a print mode is input to the BG exposure clock output section 305 to cause the BG exposure clock output section 305 to determine the input signal. For example, the print image clock f0 may be input to the BG exposure clock output section 305 to determine the print mode by the value of the frequency.

In the third embodiment, a frequency subjected to sweep diffusion is stored in advance and the BG exposure clock output section 305 may sequentially read and output the frequency. Apparently this applies to the BG exposure clock output section 305 in FIG. 8 according to the fourth embodiment.

Other Embodiments

The first to sixth embodiments describe a four-color image forming apparatus, but the present invention is not limited to the color image forming apparatus as long as the image forming apparatus performs BG exposure. For example, the present invention may be applied to a single-color image forming apparatus.

The first to sixth embodiments describe a tandem color image forming apparatus, but the present invention is not limited to the tandem color image forming apparatus as long as the image forming apparatus performs BG exposure. For example, the present invention may be applied to a rotary color image forming apparatus having belt-like intermediate transfer body.

In the first to sixth embodiments, the frequency of the BG exposure clock is subjected to random diffusion or sweep diffusion, but the present invention is not limited to the random diffusion and the sweep diffusion as long as the frequency diffusion can diffuse unnecessary radiation noise.

In the fourth embodiment, the BG exposure mask pattern generation section determines whether or not the print image exposure pattern contains ON data in the period after T0 or before 2×T0, but the present invention is not limited to the time period as long as the time period is longer than the minimum ensured time of turning-off of the light emitting element of a laser scanner. For example, a determination may be made as whether or not the print image exposure pattern contains ON data in the period after or before twice the minimum ensured time of turning-off.

Thus, the aforementioned embodiments including other embodiments can reduce the electromagnetic field intensity occurring as unnecessary radiation by means of a simple configuration.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2010-179505, filed Aug. 10, 2010, and No. 2011-112636, filed May 19, 2011 which are hereby incorporated by reference herein in their entirety.

What is claimed is:

1. An image forming apparatus that emits light from a light emitting element for a toner image forming region on a photosensitive member according to input image data and exposes the photosensitive member, the image forming apparatus comprising:

a first clock output unit that outputs a clock to slightly emit light from the light emitting element for a non-toner image forming region on the photosensitive member;

a second clock output unit that outputs a clock for emitting light from the light emitting element and exposes the photosensitive member for the toner image forming region on the photosensitive member according to the image data; and a control unit that, based on the clock output from said first clock output unit, controls the light emitting element to slightly emit light to slightly expose the photosensitive member, wherein said first clock output unit outputs the clock for performing the slight exposure with a frequency diffused within a predetermined frequency range, wherein said first clock output unit diffuses a frequency of the clock for performing the slight exposure around a frequency of the clock output from said second clock output unit, wherein said second clock output unit is configured to output a clock for a first print mode in which the light emitting element emits light to perform the exposure in the first print mode, and a clock for a second print mode in which the light emitting element emits light to perform the exposure in the second print mode different from that in the first print mode, the clock for the first print mode being different from the clock for the second print mode, and wherein said first clock output unit diffuses the frequency of the clock for performing the slight exposure in the second print mode with a frequency around the clock for the first print mode or the clock for the second print mode in each of the first print mode or the second print mode.

2. An image forming apparatus according to claim 1, operable in a plurality of print modes, wherein said first clock output unit outputs the diffused clock for performing the slight exposure in the predetermined frequency range, which is different for each print mode.

3. An image forming apparatus according to claim 1, wherein the diffused frequency is randomly diffused in the predetermined frequency range.

4. An image forming apparatus according to claim 1, wherein the diffused frequency is sweep-diffused in the predetermined frequency range.

5. An image forming apparatus according to claim 1, wherein the predetermined frequency range is a range in a vicinity of the frequency of the clock generated by said second clock output unit.

6. An image forming apparatus according to claim 1, further comprising an image processing unit, wherein the image data is processed and binarized by said image processing unit.

7. An image forming apparatus according to claim 1, wherein a time period during which the light emitting element emits light based on a pattern of the slight exposure is shorter than a predetermined value, and a time period during which the light emitting element emits light based on an exposure pattern generated by the image data is equal to or greater than the predetermined value, and the image data for generating the exposure pattern is multivalued image data.

8. An image forming apparatus that emits light from a light emitting element for a toner image forming region on a photosensitive member according to input image data and exposes the photosensitive member, the image forming apparatus comprising:

a first clock output unit that outputs a clock to slightly emit light from the light emitting element for a non-toner image forming region on the photosensitive member;

a second clock output unit that outputs a clock for emitting light from the light emitting element and exposes the photosensitive member for the toner image forming region on the photosensitive member according to the image data;

a control unit that, based on the clock output from said first clock output unit, controls the light emitting element to slightly emit light to slightly expose the photosensitive member;

an exposure pattern generation unit that generates an exposure pattern based on the image data and the clock output from said second clock output unit;

a mask pattern generation unit that generates a mask pattern before a rising edge or a falling edge of the exposure pattern by a predetermined time and after the falling edge or the rising edge of the exposure pattern by a predetermined time; and a slight exposure pattern generation unit that generates a slight exposure pattern based on the clock output from said first clock output unit, wherein said first clock output unit outputs the clock for performing the slight exposure with a frequency diffused within a predetermined frequency range, wherein said first clock output unit diffuses a frequency of the clock for performing the slight exposure around a frequency of the clock output from said second clock output unit, and wherein said control unit controls the light emitting element to slightly emit light based on the exposure pattern generated by said exposure pattern generation unit, the mask pattern generated by said mask pattern generation unit, and the slight exposure pattern generated by said slight exposure pattern generation unit and performs the slight exposure.

9. An image forming apparatus according to claim 8, further comprising a correction unit that corrects the slight exposure pattern generated by said slight exposure pattern generation unit based on the mask pattern generated by said mask pattern generation unit, wherein said control unit controls the light emitting element to slightly emit light based on the exposure pattern generated by said exposure pattern generation unit and the slight exposure pattern corrected by said correction unit to perform the slight exposure.

10. An image forming apparatus according to claim 8, wherein the predetermined time is shorter than a cycle of the clock output from said second clock output unit.

11. An image forming apparatus according to claim 8, wherein the diffused frequency is randomly diffused in the predetermined frequency range.

12. An image forming apparatus according to claim 8, wherein the diffused frequency is sweep-diffused in the predetermined frequency range.

13. An image forming apparatus according to claim 8, wherein the predetermined frequency range is a range in a vicinity of the frequency of the clock generated by said second clock output unit.

14. An image forming apparatus according to claim 8, further comprising an image processing unit, wherein the image data is processed and binarized by said image processing unit.

15. An image forming apparatus according to claim 8, wherein a time period during which the light emitting element emits light based on the slight exposure pattern is shorter than a predetermined value, and a time period during which the light emitting element emits light based on the exposure pattern is equal to or greater than the predetermined value, and the image data for generating the exposure pattern is multivalued image data.

16. An image forming apparatus that emits light from a light emitting element for a toner image forming region on a photosensitive member according to input image data and exposes the photosensitive member, the image forming apparatus comprising:

a first clock output unit that outputs a clock to slightly emit light from the light emitting element for a non-toner image forming region on the photosensitive member; and a control unit that, based on the clock output from said first clock output unit, controls the light emitting element to slightly emit to slightly expose the photosensitive member, wherein said first clock output unit outputs the clock for performing the slight exposure with a frequency randomly diffused within a predetermined frequency range.

17. An image forming apparatus according to claim 16, further comprising a second clock output unit that outputs a clock for emitting light from the light emitting element and exposes the photosensitive member for the toner image forming region on the photosensitive member according to the image data, wherein said first clock output unit diffuses a frequency of the clock for performing the slight exposure around a frequency of the clock output from said second clock output unit.

18. An image forming apparatus according to claim 16, operable in a plurality of print modes, wherein said first clock output unit outputs the diffused clock for performing the slight exposure in the predetermined frequency range, which is different for each print mode.

19. An image forming apparatus according to claim 17, wherein the predetermined frequency range is a range in a vicinity of the frequency of the clock generated by said second clock output unit.

20. An image forming apparatus according to claim 16, further comprising an image processing unit, wherein the image data is processed and binarized by said image processing unit.

21. An image forming apparatus according to claim 16, wherein a time period during which the light emitting element emits light based on a pattern of the slight exposure is shorter than a predetermined value, and a time period during which the light emitting element emits light based on an exposure pattern generated by the image data is equal to or greater than the predetermined value, and the image data for generating the exposure pattern is multivalued image data.

* * * * *